US011214749B2

(12) United States Patent
Monden et al.

(10) Patent No.: US 11,214,749 B2
(45) Date of Patent: Jan. 4, 2022

(54) LUBRICATING OIL COMPOSITION AND METHOD OF PRODUCING THE SAME

(71) Applicant: SHOWA DENKO K.K., Tokyo (JP)

(72) Inventors: Ryuji Monden, Tokyo (JP); Yu Gao, Tokyo (JP); Kunio Kondo, Tokyo (JP); Masumi Kuritani, Tokyo (JP)

(73) Assignee: SHOWA DENKO K.K., Tokyo (JP)

( * ) Notice: Subject to any disclaimer, the term of this patent is extended or adjusted under 35 U.S.C. 154(b) by 0 days.

(21) Appl. No.: 16/758,234

(22) PCT Filed: Oct. 24, 2018

(86) PCT No.: PCT/JP2018/039454
§ 371 (c)(1),
(2) Date: Apr. 22, 2020

(87) PCT Pub. No.: WO2019/082917
PCT Pub. Date: May 2, 2019

(65) Prior Publication Data

US 2020/0339904 A1 Oct. 29, 2020

(30) Foreign Application Priority Data

Oct. 25, 2017 (JP) ..... JP2017-206645

(51) Int. Cl.

| | |
|---|---|
| ***C10M 125/02*** | (2006.01) |
| ***C10M 169/04*** | (2006.01) |
| ***C10N 60/00*** | (2006.01) |
| ***C10N 30/06*** | (2006.01) |
| ***C10N 40/25*** | (2006.01) |
| ***C10N 60/10*** | (2006.01) |
| ***C10N 60/12*** | (2006.01) |

(52) U.S. Cl.
CPC ..... *C10M 125/02* (2013.01); *C10M 169/04* (2013.01); *C10M 2201/14* (2013.01); *C10M 2203/003* (2013.01); *C10N 2030/06* (2013.01); *C10N 2040/25* (2013.01); *C10N 2060/01* (2020.05); *C10N 2060/10* (2013.01); *C10N 2060/12* (2013.01)

(58) Field of Classification Search
CPC ..... C10M 125/02; C10M 169/04; C10M 2060/01; C10M 2201/14; C10M 2203/003; C10N 2030/06; C10N 2040/25; C10N 2060/01; C10N 2060/10; C10N 2060/12
See application file for complete search history.

(56) References Cited

U.S. PATENT DOCUMENTS 5,292,444 A 3/1994 Patil et al.
5,454,961 A 10/1995 Schriver et al.
(Continued)

FOREIGN PATENT DOCUMENTS

CN 103396865 A 11/2013
CN 105523924 A 4/2016
(Continued)

OTHER PUBLICATIONS

International Search Report for PCT/JP2018/039454 dated Jan. 29, 2019 [PCT/ISA/210].
(Continued)

*Primary Examiner* — James C Goloboy
(74) *Attorney, Agent, or Firm* — Sughrue Mion, PLLC

(57) ABSTRACT

The lubricating oil composition includes a base oil and a fullerene adduct.

19 Claims, 1 Drawing Sheet

(56) References Cited

U.S. PATENT DOCUMENTS

| | | | | |
|---|---|---|---|---|
| 5,462,680 | A * | 10/1995 | Brois | C10M 127/00 508/110 |
| 5,611,824 | A * | 3/1997 | Stephens | C10L 1/00 44/282 |
| 2011/0015106 | A1* | 1/2011 | Habeeb | C10M 145/22 508/465 |
| 2012/0032543 | A1* | 2/2012 | Chakraborty | C10M 125/02 310/90 |
| 2016/0347703 | A1* | 12/2016 | Igarashi | C07C 69/65 |
| 2019/0032971 | A1 | 1/2019 | Ishida et al. | |

FOREIGN PATENT DOCUMENTS

| | | | |
|---|---|---|---|
| JP | 2006-131874 | A | 5/2006 |
| JP | 2008-266501 | A | 11/2008 |
| JP | 2017-014192 | A | 1/2017 |
| JP | 2017-88757 | A | 5/2017 |
| JP | 2017-101169 | A | 6/2017 |
| WO | 2017/141825 | A1 | 8/2017 |

OTHER PUBLICATIONS

Extended European Search Report dated Jul. 7, 2021 in Application No. 18869957.3.

Liu Yuhong et al., "Tunable tribological properties in water-based lubrication of water-soluble fullerene derivatives via varying terminal groups", Chinese Science Bulletin, vol. 57, No. 35, Dec. 2012, pp. 4641-4645, (5 pages total).

Office Action from China National Intellectual Property Administration in Application No. 201880068465.7 dated Sep. 28, 2021; 10 pages total including partial translation.

* cited by examiner

LUBRICATING OIL COMPOSITION AND METHOD OF PRODUCING THE SAME

CROSS REFERENCE TO RELATED APPLICATIONS

This application is a National Stage of International Application No. PCT/JP2018/039454 filed Oct. 24, 2018, claiming priority based on Japanese Patent Application No. 2017-206645 filed Oct. 25, 2017, the contents of which are incorporated herein by reference.

TECHNICAL FIELD

The present invention relates to a lubricating oil composition and a method of producing the same.

BACKGROUND TECHNOLOGY

In recent years, there was a strong demand for improving the performance of lubricating oils used in automobiles, home appliances, industrial machinery, and the like, in accordance with improvements in speed, efficiency, and energy conservation. In order to improve the properties to suit the application, lubricating oils are formulated with a variety of additives such as antioxidants, extreme pressure additives, anti-rust additives, corrosion inhibitors, and the like. On the other hand, from the viewpoint of safety, a lubricating oil having a high flash point is required.

In order to meet these requirements and simultaneously improve performances such as low friction, high torque, and low fuel consumption, there is known an additive composition for engine lubricating oils, which comprises a lubricating base oil such as mineral oil and ester oil, and nanocarbon particles such as fullerenes in which an organic solvent, a viscosity index improver, a friction modifier, and a detergent dispersant are added (For example, see Patent Document 1).

There is also known a technique of suppressing friction and wear of a refrigerant compressor by adding fullerene having a diameter of 100 pm to 10 nm to a refrigerant oil that lubricates a sliding portion of the refrigerant compressor (For example, see Patent Document 2).

[Patent Document 1] Japanese Unexamined Patent Application Publication No. 2008-266501

[Patent Document 2] WO 2017/141825

SUMMARY OF THE INVENTION

However, in the inventions described in Patent Documents 1 and 2, no sufficient effect is obtained in terms of improvement of wear resistance.

The present invention has been made in view of the above circumstances, and an object of the present invention is to provide a lubricating oil composition having improved wear resistance and a method of producing the same.

[1] A lubricating oil composition comprising: a base oil and a fullerene adduct.

[2] The lubricating oil composition according to [1], wherein the fullerene adduct is a compound obtained by adding at least one compound selected from a group consisting of a hydrocarbon, a compound having an ether bond, a compound having an ester bond, a compound having a phosphate ester bond, a compound having a disulfide bond, a compound having a phenol hydroxyl group and a silicone to a fullerene.

[3] The lubricating oil composition according to [2], wherein the fullerene is a mixture containing $C_{60}$ and $C_{70}$.

[4] The lubricating oil composition according to any one of [1] to [3], further comprising an oil different from the base oil.

[5] A method of producing a lubricating oil composition according to any one of [1] to [4], the method comprising: obtaining a mixture of the base oil and a fullerene by mixing the base oil and the fullerene, and dissolving the dissolved component of the fullerene in the base oil; and heat-treating the mixture in an atmosphere containing lower oxygen content than in air.

[6] The method of producing the lubricating oil composition according to [5], further comprising: adding a reactive component reactive with the fullerene to the mixture.

[7] The method of producing the lubricating oil composition according to [5] or [6], further comprising: diluting the mixture with the base oil or an oil different from the base oil.

According to the present invention, there can be provided a lubricating oil composition having improved wear resistance and a method of producing the same.

DESCRIPTION OF EMBODIMENTS

Figure 1:
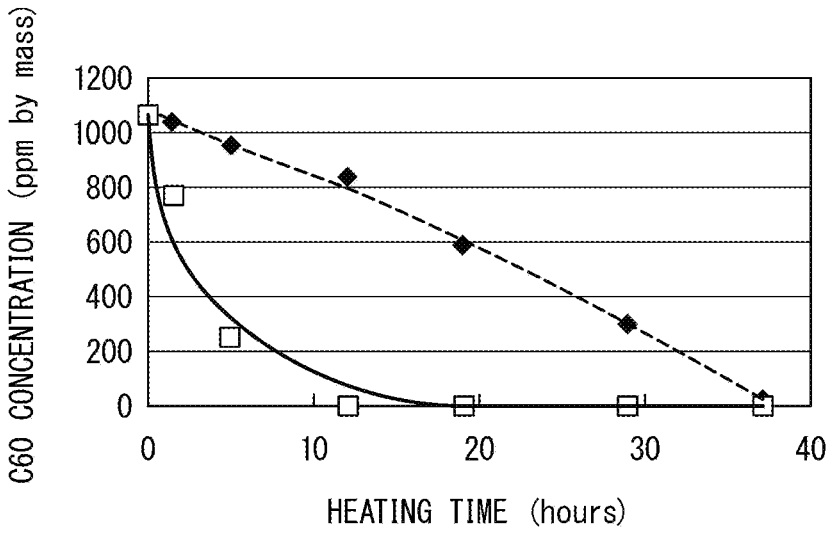
FIG. 1 is a diagram showing the relationship between the heating time and the concentration of fullerene $C_{60}$ in Example 1 and Comparative Example 1.

Hereinafter, embodiments of a lubricating oil composition and a method of producing the same to which the present invention is applied will be described below.

The present embodiment is specifically described for better understanding of the spirit of the present invention, and does not limit the present invention unless otherwise specified.

[Lubricating Oil Composition]

The lubricating oil composition of this embodiment includes a base oil and a fullerene adduct.

(Base Oil)

The base oil contained in the lubricating oil composition of the present embodiment is not particularly limited, and mineral oils and synthetic oils widely used as base oils for lubricating oils are suitably used.

Mineral oils used as lubricating oils are generally those in which the double bonds contained therein are saturated by hydrogenation and converted into saturated hydrocarbons. Examples of such mineral oil include paraffinic base oil and naphthenic base oil.

As synthetic oils, synthetic hydrocarbon oils, ether oils, ester oils, and the like may be used. Specifically, poly α-olefin, diester, polyalkylene glycol, polyalkylvinyl ether, polybutene, isoparaffin, olefin copolymer, alkylbenzene, alkylnaphthalene, diisodecyl adipate, monoester, dibasic acid ester, tribasic acid ester, polyol ester (trimethylolpropane caprylate, trimethylolpropane pelargonate, pentaerythritol 2-ethylhexanoate, pentaerythritol pelargonate, or the like), dialkyl diphenyl ether, alkyl diphenyl sulfide, polyphenyl ether, silicone lubricating oil (dimethyl silicone, or the like), perfluoropolyether, 1,2,4-trimethylbenzene, and the like are preferably used. Among these, poly α-olefins, diesters, polyol esters, polyalkylene glycols, polyalkyl vinyl ethers, and 1,2,4-trimethylbenzene are more preferably used.

One kind of mineral oil or synthetic oil may be used alone, or two or more kinds selected from the mineral oil or synthetic oil may be mixed at an arbitrary ratio.

(Reactive Component)

A fullerene adduct is formed by chemically bonding a reactive component to a fullerene. The fullerene adduct is preferably a compound obtained by adding at least one compound selected from a group consisting of a hydrocarbon, a compound having an ether bond, a compound having an ester bond and a silicone to the fullerene.

The reactive component is preferably a compound having a high affinity for the lubricating oil (mineral oil and synthetic oil) in terms of solubility.

The reactive component is more preferably a compound having a structure similar to that of the main component of the lubricating oil in that the reactive component has a high affinity with the lubricating oil in terms of solubility.

Further, from the viewpoint of ease of production, the reactive component is preferably a component contained in mineral oil or synthetic oil, and is preferably a compound that is capable of chemically bonding with fullerenes at about 200° C. or less.

When the lubricating oil is a mineral oil, a hydrocarbon such as paraffin, olefin, naphthene or aromatic is preferable as the reactive component. When the lubricating oil is a synthetic oil, a compound having a skeleton such as polyether or polyester is preferable as the reactive component. These reactive components are generally present in lubricating oils in small amounts as by-products or unavoidable impurities of the lubricating oil.

The reactive component is preferably, for example, a saturated hydrocarbon having a side chain or a ring, an unsaturated hydrocarbon such as a diene or an aromatic, a compound having a plurality of rings, an aromatic having an alkyl side chain, a compound having an ether bond, a compound having an ester bond, a compound having a phosphate ester bond, a compound having a disulfide bond, a compound having a phenol hydroxyl group, or a silicone in terms of chemically bonding to fullerenes at about 200° C. or less.

Specific examples of such reactive components include straight or branched hydrocarbons (for example, hexane, decane, cyclohexane, isobutane, decalin, or the like), hydrocarbons having unsaturated double bonds (for example, hexacene, pentacene, cyclohexene, decene, turpentine oil, terpene derivatives, α-olefins, or the like), aromatic hydrocarbons having alkyl (for example, polycyclic aromatic hydrocarbons such as dodecylbenzene, hexabenzene, ethylbenzene, trimethylbenzene, tetramethylbenzene, cumene, methylnaphthalene, anthracene, butacene, and hexacene), compounds having ether bonds (for example, tripropylene glycol, dipropylene glycol, triethylene glycol, tetrahydrofuran, or the like), compounds having ester groups (for example, ethyl acetate, octyl acetate, or the like), γ-butyrolactone and fats (fatty acid glycerol ester), compounds having phosphate ester bonds (for example, tricresyl phosphate (TCP), triphenyl phosphate (TPP), 2,6-di-tert-butylphenol (DTP), or the like), compounds having disulfide bonds (for example, dibenzyl disulfide (DBDS), di-p-tolyl disulfide (DTDS), or the like), compounds having a phenol hydroxyl group (for example, 3,5-di-tert-butyl-4 hydroxytoluene (BHT), butylhydroxyanisole (BHA), 2,6-butylphenol (DTP), bis (3,5-di-tert-butyl-4-hydroxyphenyl) methane (BDBA), 2,4,6-tributylphenol (TBP), or the like), diazo compounds, silicones, and combinations thereof. It is considered that these compounds generate radicals by heating in a base oil and react with fullerenes to form fullerene adducts.

The reactive component is chemically bonded (addition) to the fullerene to form a fullerene adduct. In such a fullerene adduct, a molecule (group) of the reactive component is present on the surface of the fullerene skeleton. Therefore, the fullerene adduct has excellent affinity with the lubricating oil due to the group obtained from the reactive component present on the surface thereof. Therefore, since the lubricating oil composition contains the fullerene adduct, the permeability of the lubricating oil composition to the sliding part of the machine or the like can be improved. That is, since the fullerene adduct is present in the sliding portion of the machine, the base oil having a high affinity for the fullerene adduct can easily permeate the sliding portion of the machine. As a result, the wear resistance of the sliding part of the machine can be improved.

The fact that the reactive component is chemically bonded to the fullerene to form the fullerene adduct can be confirmed by liquid chromatography mass spectrometry (Liquid Chromatography Mass Spectrometry, LC-MS).

(Fullerene)

The fullerene contained in the lubricating oil composition of the present embodiment is not particularly limited in structure or manufacturing method, and various fullerenes can be used. Examples of fullerenes include $C_{60}$ and $C_{70}$ which are relatively easy to obtain, higher order fullerenes, or mixtures thereof. Among the fullerenes, Cho and $C_{70}$ are preferable from the viewpoint of high solubility in the base oil, and $C_{60}$ is more preferable from the viewpoint of less coloring in the base oil. In the case of a mixture of $C_{60}$ and $C_{70}$, Coo is preferably contained in an amount of 50 mass % or more.

(Additive)

The lubricating oil composition of the present embodiment can contain additives within a range that does not impair the effect of the present embodiment.

The additive to be blended in the lubricating oil composition of the present embodiment is not particularly limited. Examples of the additives include commercially available antioxidants, viscosity index improvers, extreme pressure additives, detergent dispersants, pour point depressants, corrosion inhibitors, solid lubricating oils, oil improvers, antirust additives, antiemulsifiers, defoaming agents, hydrolysis inhibitors, and the like. One or more of these additives may be used alone or in combination.

As the additive, those having an aromatic ring are more preferable.

Examples of the antioxidant having an aromatic ring include dibutylhydroxytoluene (BHT), butylhydroxyanisole (BHA), 2,6-butylphenol (DTP), bis (3,5-dibutyl-4-hydroxyphenyl) methane (BDBA), 2,4,6-tributylphenol (TBP, 3-arylbenzofuran-2-one (Intramolecular cyclic esters of hydroxycarboxylic acids), phenyl-α-naphthylamine, dialkyldiphenylamine, benzotriazole, and the like.

Examples of the viscosity index improver having an aromatic ring include a polyalkylstyrene and a hydride additive of a styrene-diene copolymer.

Examples of the extreme-pressure additive having an aromatic ring include dibenzyl disulfide, allyl phosphate ester, allyl phosphite ester, amine salt of allyl phosphate ester, allyl thiophosphate ester, amine salt of allyl thiophosphate ester, naphthenic acid, and the like.

Examples of the detergent dispersant having an aromatic ring include benzylamine succinic acid derivatives, alkylphenol amines, and the like.

The pour point depressant having an aromatic ring includes a chlorinated paraffin-naphthalene condensate, a chlorinated paraffin-phenol condensate, a polyalkylstyrene system, or the like Examples of the antiemulsifier having an aromatic ring include alkylbenzene sulfonate.

Examples of the corrosion inhibitor having an aromatic ring include dialkyl naphthalene sulfonate and the like.

The lubricating oil composition of the present embodiment may contain an oil different from the base oil.

The lubricating oil composition of the present embodiment can be produced by a method of producing a lubricating oil composition described later.

According to the lubricating oil composition of the present embodiment, since the lubricating oil composition includes a base oil and a fullerene adduct, wear resistance can be improved.

The lubricating oil composition of the present embodiment can be used for various applications such as an industrial gear oil; hydraulic fluid; compressor oil; refrigerating machine oil; cutting oil; plastic working oil such as rolling oil, press oil, forging oil, drawing oil, pulling out oil and punching oil; metal processing oil such as heat treatment oil and electric discharge processing oil; sliding guide oil; bearing oil; rust preventive oil; heating medium oil; or the like.

[Method of Producing Lubricating Oil Composition]

The method of producing the lubricating oil composition of the present embodiment includes a step of obtaining a mixture of the base oil and a fullerene by mixing the base oil and the fullerene, and dissolving the dissolved component of the fullerene in the base oil (Hereinafter referred to as "first step"); and a step of heat-treating the mixture in an atmosphere containing lower oxygen content than in air (Hereinafter referred to as "second step").

The method of producing the lubricating oil composition of the present embodiment may include a step of removing insoluble components contained in the mixture of the base oil and the fullerene (Hereinafter referred to as "third step"). The method of producing the lubricating oil composition of the present embodiment may include a step of adding the reactive component to a mixture of the base oil and fullerene (Hereinafter referred to as "fourth step"). Further, the method of producing the lubricating oil composition of the present embodiment may include a step of diluting a mixture of the base oil and the fullerene with the base oil or an oil different from the base oil within a range in which desired lubricating characteristics can be obtained (Hereinafter referred to as "fifth step").

Hereinafter, the method of producing the lubricating oil composition of the present embodiment will be described in detail.

(First Step)

The fullerene as a raw material is charged into the base oil and subjected to a dispersion treatment, preferably for 3 to 48 hours, while at about room temperature or heating as needed using a dispersion device such as an agitator, to obtain a mixture of the base oil and the fullerene.

The charging amount of the fullerene as the raw material is, for example, 1.2 to 5 times, more preferably 1.2 to 3 times the amount of the fullerene for which the desired concentration of the fullerene can be obtained with respect to the base oil by calculation in consideration of the fullerene concentration of the lubricating oil composition to be finally prepared. Within the above range, a desired fullerene concentration can be easily obtained, and insoluble components can be easily removed.

Examples of the dispersing devices include a stirrer, an ultrasonic disperser, a homogenizer, a ball mill, and a bead mill.

(Second Step)

The Lubricating oil composition is obtained by heat-treating a mixture (Hereinafter, it is also referred to as "fullerene solution") of the base oil and fullerene obtained in the first step.

Before the second step, the fullerene solution obtained in the third step described below may be diluted with the base oil or an oil different from the base oil in the fifth step described below, and then the fullerene solution after dilution may be heat-treated in the second step to obtain a lubricating oil composition. The second step may be performed after the third step described later or after the fifth step described later.

Since the mixture obtained in the first step is exposed to the atmosphere in the first step and the third step described later, the internal oxygen concentration is in equilibrium with the oxygen in air. Therefore, the second step includes an operation for reducing the oxygen concentration in the mixture to a level lower than that of the mixture left in air. Preferably, the oxygen concentration in the mixture is 10 ppm by mass or less, more preferably 5 ppm by mass or less, and still more preferably 1 ppm by mass or less. Thereafter, when the oxygen concentration is lowered, the fullerene solution is heat-treated without being brought into contact with air again.

In the second step, for example, the oxygen concentration in the fullerene solution is lowered by the following four methods, and then the fullerene solution in which the oxygen concentration is lowered is heat-treated.

The first method is explained.

A fullerene solution is stored in an airtight metallic container such as stainless steel.

Then, the inside of the container is replaced with an inert gas such as nitrogen gas or the fullerene solution in the container is bubbled with the inert gas to bring the fullerene solution into equilibrium with the inert gas.

Next, the container is sealed, and the fullerene solution is heat-treated by heating the container while keeping the equilibrium state of the fullerene solution and the inert gas.

In the first method, the heat treatment of the fullerene solution is performed in an atmosphere containing lower oxygen content than in air by the above method.

The second method is explained.

A fullerene solution is stored in an airtight metallic container such as stainless steel.

The container is then depressurized to reduce the oxygen concentration in the fullerene solution.

Next, the container is sealed, and the fullerene solution is heat-treated by heating the container while keeping the oxygen concentration in the fullerene solution lowered.

In the second method, the heat treatment of the fullerene solution is performed in an atmosphere containing lower oxygen content than in air by the above method.

The third method is explained.

A fullerene solution is stored in an airtight metallic container such as stainless steel.

The container is then depressurized to reduce the oxygen concentration in the fullerene solution.

Then, the inside of the container is replaced with an inert gas such as nitrogen gas or the fullerene solution in the container is bubbled with the inert gas to bring the fullerene solution into equilibrium with the inert gas.

Next, the container is sealed, and the fullerene solution is heat-treated by heating the container while keeping the equilibrium state of the fullerene solution and the inert gas.

In the third method, the heat treatment of the fullerene solution is performed in an atmosphere containing lower oxygen content than in air by the above method.

The fourth method is explained.

The fullerene solution is stored in an airtight container including a compression device and a drive device such as a compression/cooling compressor.

Next, the container is filled with a fluorocarbon gas (F134A, F22, or the like), a hydrocarbon gas (isobutane), ammonia, or the like Then, the fullerene solution is heat-treated by sealing the container and heating the container.

In the fourth method, the heat treatment of the fullerene solution is performed in an atmosphere containing lower oxygen content than in air by the above method.

The higher the heating temperature of the fullerene solution, the shorter the heating time. However, when the heating temperature is high, the components of the base oil tend to evaporate.

Therefore, the upper limit of the heating temperature of the fullerene solution is preferably set at a temperature at which the fullerene solution does not decrease due to evaporation of the base oil. However, when the evaporation component is recovered in a cooling tube or the like and returned to the fullerene solution, or when heat treatment is performed in a state where evaporation is suppressed in the pressure vessel, the heat treatment temperature can be set higher than the temperature at which the base oil evaporates.

The heating temperature of the fullerene solution is preferably 250° C. or less, and more preferably 150° C. or less in order to suppress deterioration and deterioration of the base oil.

However, the lower the heating temperature of the mixture, the longer the heating time.

In the case of industrially producing the lubricating oil composition, the heating temperature is preferably 100° C. or higher, more preferably 120° C. or higher from the viewpoint of the treatment time.

The higher the heating temperature, the faster the heat treatment of the mixture proceeds and the shorter the heating time.

The lower the oxygen concentration in the fullerene solution, the more easily the lubricating effect of the lubricating oil composition is improved because the thermal deterioration of the base oil is suppressed in the heat treatment of the fullerene solution.

The concentration of oxygen in the fullerene solution is preferably lower than the concentration of oxygen in air, and more preferably 1/10 or less of the concentration of oxygen in air.

The concentration of oxygen in the fullerene solution can be measured using a dissolved oxygen meter.

In the second step, the reactive component is chemically bonded to the fullerene by heat-treating the fullerene solution to form a fullerene adduct. Therefore, the concentration of fullerene in the lubricating oil composition obtained after the heat treatment is lower than the concentration of fullerene in the fullerene solution before the heat treatment. In other words, since the fullerene adduct is formed by the heat treatment, the fullerene is consumed and its concentration is lower than that before the heat treatment.

Therefore, in the second step, it is preferable to terminate the heat treatment when the ratio of the concentration of fullerene in the fullerene solution before the heat treatment with respect to the concentration of fullerene in the lubricating oil composition obtained after the heat treatment (Hereinafter, it is sometimes referred to as "concentration ratio before and after heat treatment") becomes 80% or less. Continuing the heat treatment further reduces the concentration of fullerenes. In the second step, it is more preferable to terminate the heat treatment when the concentration ratio before and after heat treatment becomes 50% or less. When further heat treatment is continued, the concentration of fullerene decreases to an undetectable level, but even when heat treatment is continued beyond this level, fullerene adducts are hardly formed. Therefore, the heat treatment is preferably terminated when the concentration ratio before and after the heat treatment is 1% or more, and more preferably, the heat treatment is terminated when the concentration ratio is 10% or more.

The concentration of the fullerene can be confirmed by liquid chromatography mass spectrometry (LC-MS). The fact that the reactive component is chemically bonded to the fullerene to form the fullerene adduct can be confirmed by the appearance of a mass peak corresponding to the fullerene adduct in mass detection.

When the fifth step described later is not performed, the lubricating oil composition of this embodiment is obtained when the second step is completed.

(Third Step)

The mixture obtained in the first step contains, as insoluble components, undissolved fullerenes such as aggregates of fullerenes derived from the raw material fullerenes, impurities of base oil, and particles mixed in the manufacturing step. Therefore, if the mixture is used as it is, there may be a problem that a sliding portion or the like in contact with the lubricating oil composition is worn. Therefore, after the first step, the third step of removing the insoluble component contained in the mixture of the base oil and the fullerene may be provided. The third step may be performed after the second step, or may be performed after the fifth step described later.

The concentration of the fullerene in the mixture (fullerene solution) from which the insoluble component is removed is preferably from 1 ppm by mass (0.0001% by mass) to 10,000 ppm by mass (1% by mass), more preferably from 1 ppm by mass (0.0001% by mass) to 100 ppm by mass (0.01% by mass), and still more preferably from 5 ppm by mass (0.0005% by mass) to 50 ppm by mass (0.005% by mass).

When the concentration of the fullerene is within the above range, the resulting lubricating oil composition exhibits wear resistance, and the wear resistance can be maintained over a long period of time by compensating for the decrease in the concentration of the fullerene due to the deterioration of the fullerene.

Examples of the third step include (1) a removing step using a membrane filter, (2) a removing step using a centrifuge, and (3) a removing step using a combination of the membrane filter and the centrifuge. Among these removing steps, (1) a removing step using a membrane filter is preferable when a small amount of solution is obtained from the viewpoint of treatment time, and (2) a removing step using a centrifuge is preferable when a large amount of solution is obtained.

(1) In the removing step using the membrane filter, for example, the mixture obtained in the first step is filtered using a small-mesh filter (for example, 0.1 μm to 1 μm mesh membrane filters), and the filtrate after removal of the insoluble matter is recovered as a fullerene solution. In order to shorten the filtration time, it is preferable to perform suction filtration, for example.

(2) In the removing step using a centrifuge, for example, the mixture obtained in the first step is centrifuged and the supernatant is recovered as a fullerene solution after removing insoluble matter.

(Fourth Step)

The method may further include a fourth step of adding the reactive component to the mixture obtained after the first step or the fullerene solution obtained in the third step.

The formation of the fullerene adduct can be controlled in the second step by adjusting the amount of the reactive component added in the fourth step. Therefore, the wear resistance of the fullerene adduct can be further improved.

(Fifth Step)

Further, the method may include a fifth step of diluting a mixture of the base oil and the fullerene with the base oil or an oil different from the base oil to obtain a lubricating oil composition having desired lubricating properties. The fifth step may be performed after the second step or may be performed after the third step.

The oil used in the fifth step may be a base oil of the same type as the base oil used in the first step or a base oil of a different type.

The fifth step also includes replacing the base oil by removing the base oil that has undergone the heat treatment in the second step and diluting it with a desired base oil.

As a method for removing the base oil, for example, a method for evaporating the base oil by heating or heating under reduced pressure or the like can be mentioned.

By removing the base oil that has undergone the heat treatment in the second step and newly diluting the base oil with the base oil not subjected to the heat treatment, the lubricating oil composition having little thermal degradation can be obtained.

According to the method of producing the lubricating oil composition of the present embodiment, a lubricating oil composition capable of improving wear resistance can be obtained.

In the method of producing the lubricating oil composition of the present embodiment, the order in which the second, third and fifth steps are performed is not limited, and these steps may be performed in any order. For the following reasons, in the method of producing the lubricating oil composition of the present embodiment, it is more preferable to perform these steps in the order of the third step, the second step, and the fifth step.

When heat treatment is performed after removing insoluble components contained in the mixture of the base oil and the fullerene, the fullerene or the like is hardly re-aggregated.

After the insoluble component is removed, the mixture of the base oil and fullerene contains a very small amount of a hardly soluble component (especially high-order fullerene), and the fullerene concentration decreases when the mixture is heat-treated. Therefore, the possibility that the hardly soluble component remains in the mixture is reduced.

The manufacturing cost of the lubricating oil composition can be reduced by removing the insoluble component in the state that the volume of the mixture of the base oil and the fullerene is small or by heat-treating the mixture.

As described above, the preferred embodiment of the present invention has been described in detail above, however, the present invention is not limited to a specific embodiment, and various modifications and changes are possible within the scope of the gist of the present invention described in the claims.

EXAMPLE

Hereinafter, the present invention will be described in more detail with reference to examples and comparative examples, but the present invention is not limited to the following examples.

Example 1

(Preparation of Lubricating Oil Composition) 100 g of 1,2,4-trimethylbenzene (TMB, manufactured by Tokyo Chemical Industry Co., Ltd.) as a base oil and 0.01 g (100 mg) of a fullerene raw material ($C_{60}$, nanom (registered trademark) NP-SUH, manufactured by Frontier Carbon Co., Ltd.) were mixed, and the mixture of the base oil and fullerene was prepared by stirring the mixture with a stirrer at room temperature for 3 hours. 1,2,4-Trimethylbenzene is also a reactive component chemically bonded to fullerene.

The resulting mixture was then filtered through a 0.1 μm mesh membrane filter to obtain a fullerene solution. The resulting fullerene solution was determined to contain 1060 ppm of fullerene by measuring the concentration of fullerene by the HPLC method.

Next, the fullerene solution was transferred to a 250 mL three-necked eggplant flask, and a Liebig condenser was attached to the 1st mouth, a silicone septum cap to the 2nd mouth, and a nitrogen introduction tube to the 3rd mouth.

Next, nitrogen was injected into the flask through a nitrogen introduction tube at a flow rate of 0.2 L/minute, and the flask was allowed to stand for 10 minutes. As a result, the inside of the flask was changed to a nitrogen atmosphere.

Next, in this state, the eggplant flask was immersed in an oil bath at 140° C., and the fullerene solution was heated to obtain the lubricating oil composition X.

Thereafter, about 10 mL of lubricating oil composition X was collected by piercing the septum cap using a glass syringe with a needle at regular intervals.

The concentration of fullerene in the recovered lubricating oil composition X was measured.

For the lubricating oil composition X recovered 12 hours after the start of heating, a fullerene adduct was confirmed.

The lubricating oil composition X 10 g, recovered 12 hours after the start of heating was collected, and concentrated to 1 g by was evaporating a part of 1,2,4-trimethylbenzene by blowing nitrogen gas.

Concentrated 1 g of the lubricating oil composition X was added to 19 g of mineral oil A (Product name: Diana Frescia P46, manufactured by Idemitsu Kosan Co., Ltd.) to give a lubricating oil composition Y.

The concentration of fullerene was measured by high-performance liquid chromatography (1200 Series from Agilent Technologies Inc.) using column YMC-Pack ODS-AM (4.6×150 mm) manufactured by YMCS Corporation. The amount of fullerene in lubricating oil composition X was determined by measuring the absorbance (Wavelength: 309 nm) of lubricating oil composition X using a 1:1 (volume ratio) mixture of toluene and methanol as the developing solvent. The relationship between the heating time and the concentration of fullerene $C_{60}$ is shown in Table 1 and FIG. 1.

A mass detector (Manufactured by Agilent Technologies Inc. LC/MS, 6120) of a liquid chromatography mass spectrometer was used to confirm the fullerene adduct. Fullerene adducts were identified in the mass range of 700 to 2000. When the fullerene adduct was confirmed, "Yes" was indicated in Table 2, and when the fullerene adduct was not confirmed, "No" was indicated in Table 2. This is not limited to this example, but is also shown in other examples and comparative examples.

(Evaluation of Wear Resistance) The obtained lubricating oil composition Y was evaluated for wear resistance using a friction and wear testing machine (Product Name: Ball-on-disk tribometer manufactured by Anton Paar).

The substrate and the ball were made of SUJ2. The diameter of the ball was 6 mm.

A lubricating oil composition Y was applied to one main surface of the substrate.

Next, the ball was slid on one main surface of the substrate via the lubricating oil composition Y so that the ball drew a concentric orbit. The speed of the ball on one main surface of the substrate was 5 mm/sec, and the load of the ball on one main surface of the substrate was 25 N. The rubbing surface (Circular) of the ball surface when the sliding distance of the ball on one main surface of the substrate was 15 m in total was observed with an optical microscope, and the diameter of the rubbing surface was measured.

Table 2 shows the diameter of the rubbing surface 12 hours after the start of heating.

(Evaluation of High Temperature Wear Resistance)

Figure 2:
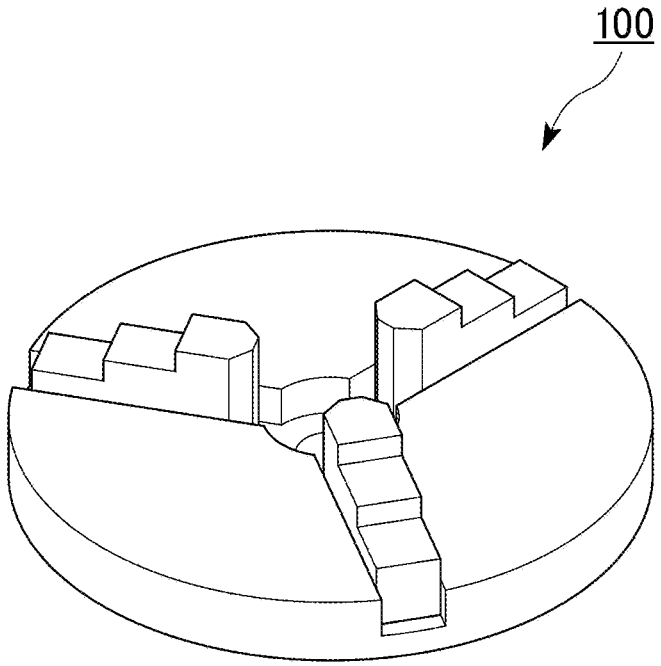
FIG. 2 is a perspective view of a chuck device used for evaluation of high temperature wear resistance in Examples 1 to 42 and Comparative Examples 1 to 41.

In the friction-and-wear testing machine used for the evaluation of wear resistance, a heater is installed in a chuck device (a tool for fixing a workpiece (object to be machined) to a machine tool such as a lathe) 100 for fixing a substrate as shown in FIG. 2, so that the temperature of the substrate fixed by the chuck device can be adjusted.

The temperature of the chuck device was set at 90° C., and the high-temperature wear resistance of the substrate was evaluated in the same manner as the wear resistance was evaluated.

The results are shown in Table 2.

(Evaluation of Load Carrying Capacity)

The resulting lubricating oil composition Y was evaluated for load carrying capacity by a method in accordance with the Soda's four-ball method specified in JIS K 2519-1995 "Lubricating oils-Testing methods for load carrying capacity".

That is, the load carrying capacity of the lubricating oil composition Y was evaluated according to the following procedures (1) to (5).

(1) A four-sphere type rubbing machine (Manufactured by Shinko Engineering Co., Ltd., with a maximum rotation speed of 3000 rpm and a maximum vertical load of 20 kN, custom-made) was used as an apparatus for measuring load carrying capacity.

(2) The lubricating oil composition Y was injected into the sample vessel of a four-sphere type rubbing machine until the three fixed spheres were immersed.

(3) The rotating sphere was rotated at 500 rpm under a load of 200 N. This condition was maintained for 30 seconds.

(4) Next, the load applied to the rotating sphere was increased by 200 N, and the rotating sphere was rotated at 500 rpm with a load of 400 N applied to the rotating sphere. This condition was maintained for 30 seconds.

(5) In this way, the load was increased by 200 N every 30 seconds, and the load at the time when the rotating sphere and the fixed sphere were fused was set as the load carrying capacity.

The results are shown in Table 2.

Comparative Example 1

A lubricating oil composition Y of Comparative Example 1 was prepared in the same manner as in Example 1 except that the inside of the flask was set to an air atmosphere in place of a nitrogen atmosphere.

In the same manner as in Example 1, the concentration of fullerene in the lubricating oil composition X was measured at regular intervals. The relationship between the heating time and the concentration of fullerene is shown in Table 1 and FIG. 1.

The wear resistance of the lubricating oil composition Y of Comparative Example 1 was evaluated in the same manner as in Example 1. Table 2 shows the diameter of the rubbing surface 12 hours after the start of heating.

The high-temperature wear resistance and load carrying capacity of the lubricating oil composition Y of Comparative Example 1 were evaluated in the same manner as in Example 1. The results are shown in Table 2.

Comparative Example 2

A lubricating oil composition Y of Comparative Example 2 was prepared in the same manner as in Example 1 except that no heat treatment was performed.

A fullerene adduct was confirmed in the same manner as in Example 1. The results are shown in Table 2.

The wear resistance of the lubricating oil composition Y of Comparative Example 2 was evaluated in the same manner as in Example 1. Table 2 shows the diameter of the rubbing surface 12 hours after the start of heating.

The high-temperature wear resistance and load carrying capacity of the lubricating oil composition Y of Comparative Example 2 were evaluated in the same manner as in Example 1. The results are shown in Table 2.

Comparative Example 3

A mixed oil was prepared by mixing 19 g of mineral oil A (Product name: Diana Frescia P 46, manufactured by Idemitsu Kosan Co., Ltd.), as a base oil, with 1 g of 1,2,4-trimethylbenzene (TMB, manufactured by Wako Pure Chemical Industries, Ltd.).

A fullerene adduct was confirmed in the same manner as in Example 1. The results are shown in Table 2.

The wear resistance of the mixed oil of Comparative Example 3 was evaluated in the same manner as in Example 1. Table 2 shows the diameter of the rubbing surface 12 hours after the start of heating.

The high-temperature wear resistance and load carrying capacity of the lubricating oil composition Y of Comparative Example 3 were evaluated in the same manner as in Example 1. The results are shown in Table 2.

Example 2

A lubricating oil composition Y of Example 2 was prepared in the same manner as in Example 1 except that 190 g of mineral oil A was added to a mixture of 1,2,4-trimethylbenzene and fullerene, and a part of 1,2,4-trimethylbenzene was evaporated to prevent concentration of lubricating oil composition X.

A fullerene adduct was confirmed in the same manner as in Example 1. The results are shown in Table 2.

The wear resistance of the lubricating oil composition Y of Example 2 was evaluated in the same manner as Example 1. Table 2 shows the diameter of the rubbing surface 12 hours after the start of heating.

The high-temperature wear resistance and load carrying capacity of the lubricating oil composition Y of Example 2 were evaluated in the same manner as in Example 1. The results are shown in Table 2.

Example 3

A lubricating oil composition Y of Example 3 was prepared in the same manner as in Example 2 except that $C_{70}$ (NOR-SU) manufactured by Frontier Carbon Co., Ltd. was used as a fullerene raw material.

A fullerene adduct was confirmed in the same manner as in Example 1. The results are shown in Table 2.

The wear resistance of the lubricating oil composition Y of Example 3 was evaluated in the same manner as Example 1. Table 2 shows the diameter of the rubbing surface 12 hours after the start of heating.

The high-temperature wear resistance and load carrying capacity of the lubricating oil composition Y of Example 3 were evaluated in the same manner as in Example 1. The results are shown in Table 2.

Example 4

A lubricating oil composition Y of Example 4 was prepared in the same manner as in Example 2, except that a mixed fullerene (NM-ST) made by Frontier Carbon Co., Ltd. was used as a fullerene raw material.

A fullerene adduct was confirmed in the same manner as in Example 1. The results are shown in Table 2.

The wear resistance of the lubricating oil composition Y of Example 4 was evaluated in the same manner as Example 1. Table 2 shows the diameter of the rubbing surface 12 hours after the start of heating.

The high-temperature wear resistance and load carrying capacity of the lubricating oil composition Y of Example 4 were evaluated in the same manner as in Example 1. The results are shown in Table 2.

Example 5

A lubricating oil composition Y of Example 5 was prepared in the same manner as in Example 1 except that 100 g of decalin (Manufactured by Tokyo Chemical Industry Co., Ltd.) was used as a base oil, and the fullerene solution was heated at 160° C. for 12 hours to remove volatile components to obtain a lubricating oil composition X, and that concentrated lubricating oil composition X was added to 50 g of poly-α-olefin (PAO, manufactured by JX Nippon Steel Nisseki Co., Ltd.) to obtain a lubricating oil composition Y.

A fullerene adduct was confirmed in the same manner as in Example 1. The results are shown in Table 2.

The wear resistance of the lubricating oil composition Y of Example 5 was evaluated in the same manner as Example 1. Table 2 shows the diameter of the rubbing surface 12 hours after the start of heating.

The high-temperature wear resistance and load carrying capacity of the lubricating oil composition Y of Example 5 were evaluated in the same manner as in Example 1. The results are shown in Table 2.

Comparative Example 4

A lubricating oil composition Y of Comparative Example 4 was prepared in the same manner as in Example 5 except that the fullerene solution was not heated.

A fullerene adduct was confirmed in the same manner as in Example 1. The results are shown in Table 2.

The wear resistance of the lubricating oil composition Y of Comparative Example 4 was evaluated in the same manner as in Example 1. Table 2 shows the diameter of the rubbing surface 12 hours after the start of heating.

The high-temperature wear resistance and load carrying capacity of the lubricating oil composition Y of Comparative Example 4 were evaluated in the same manner as in Example 1. The results are shown in Table 2.

Example 6

A lubricating oil composition Y of Example 6 was prepared in the same manner as in Example 1 except that 90 g of toluene (Manufactured by Tokyo Chemical Industry Co., Ltd.) was used as a base oil, 10 g of dimethylcumene (DMC, manufactured by Tokyo Chemical Industry Co., Ltd.) was used as a reactive component, the fullerene solution was heated at 150° C. for 12 hours to remove volatiles, and 0.07 g of a solid component (Lubricating oil composition X) from which volatiles had been removed was taken out and added to 19 g of mineral oil A.

A fullerene adduct was confirmed in the same manner as in Example 1. The results are shown in Table 2.

The wear resistance of the lubricating oil composition Y of Example 6 was evaluated in the same manner as Example 1. Table 2 shows the diameter of the rubbing surface 12 hours after the start of heating.

The high-temperature wear resistance and load carrying capacity of the lubricating oil composition Y of Example 6 were evaluated in the same manner as in Example 1. The results are shown in Table 2.

Comparative Example 5

A lubricating oil composition Y of Comparative Example 5 was prepared in the same manner as in Example 6 except that the fullerene solution was not heated.

A fullerene adduct was confirmed in the same manner as in Example 1. The results are shown in Table 2.

The wear resistance of the lubricating oil composition Y of Comparative Example 5 was evaluated in the same manner as in Example 1. Table 2 shows the diameter of the rubbing surface 12 hours after the start of heating.

The high-temperature wear resistance and load carrying capacity of the lubricating oil composition Y of Comparative Example 5 were evaluated in the same manner as in Example 1. The results are shown in Table 2.

Example 7

A lubricating oil composition Y of Example 7 was prepared in the same manner as in Example 1, except that 90 g of benzene (Manufactured by Tokyo Chemical Industry Co., Ltd.) was used as a base oil, 10 g of di-p-tolyl ether (DTE, manufactured by Tokyo Chemical Industry Co., Ltd.) was used as a reactive component, the fullerene solution was heated at 160° C. for 12 hours to remove volatiles to obtain a lubricating oil composition X, and that concentrated lubricating oil composition X was added to 50 g of polyol ester (POE-A, polyol ester type, Unister™ H-334 R, manufactured by NOF Corporation) to obtain lubricating oil composition Y.

A fullerene adduct was confirmed in the same manner as in Example 1. The results are shown in Table 2.

The wear resistance of the lubricating oil composition Y of Example 7 was evaluated in the same manner as Example 1. Table 2 shows the diameter of the rubbing surface 12 hours after the start of heating.

The high-temperature wear resistance and load carrying capacity of the lubricating oil composition Y of Example 7 were evaluated in the same manner as in Example 1. The results are shown in Table 2.

Comparative Example 6

A lubricating oil composition Y of Comparative Example 6 was prepared in the same manner as in Example 7 except that the fullerene solution was not heated.

A fullerene adduct was confirmed in the same manner as in Example 1. The results are shown in Table 2.

The wear resistance of the lubricating oil composition Y of Comparative Example 6 was evaluated in the same manner as in Example 1. Table 2 shows the diameter of the rubbing surface 12 hours after the start of heating.

The high-temperature wear resistance and load carrying capacity of the lubricating oil composition Y of Comparative Example 6 were evaluated in the same manner as in Example 1. The results are shown in Table 2.

Example 8

The lubricating oil composition Y of Example 8 was prepared in the same manner as in Example 1 except that 100 g of polyol ester (POE-A, polyol ester type, Unister™ H-334 R, manufactured by NOF Corporation) was used as a base oil, the fullerene solution was heated at 150° C. for 12 hours, and the lubricating oil composition Y was obtained without diluting the lubricating oil composition X.

A fullerene adduct was confirmed in the same manner as in Example 1. The results are shown in Table 2.

The wear resistance of the lubricating oil composition Y of Example 8 was evaluated in the same manner as Example 1. Table 2 shows the diameter of the rubbing surface 12 hours after the start of heating.

The high-temperature wear resistance and load carrying capacity of the lubricating oil composition Y of Example 8 were evaluated in the same manner as in Example 1. The results are shown in Table 2.

Comparative Example 7

A lubricating oil composition Y of Comparative Example 7 was prepared in the same manner as in Example 8 except that the fullerene solution was not heated.

A fullerene adduct was confirmed in the same manner as in Example 1. The results are shown in Table 2.

The wear resistance of the lubricating oil composition Y of Comparative Example 7 was evaluated in the same manner as in Example 1. Table 2 shows the diameter of the rubbing surface 12 hours after the start of heating.

The high-temperature wear resistance and load carrying capacity of the lubricating oil composition Y of Comparative Example 7 were evaluated in the same manner as in Example 1. The results are shown in Table 2.

Example 9

A lubricating oil composition Y of Example 9 was prepared in the same manner as in Example 1 except that 100 g of monoester (POE-B, monoester type, Unister™ MB-881, manufactured by NOF Corporation) was used as a base oil and the fullerene solution was heated at 150° C. for 12 hours.

A fullerene adduct was confirmed in the same manner as in Example 1. The results are shown in Table 2.

The wear resistance of the lubricating oil composition Y of Example 9 was evaluated in the same manner as Example 1. Table 2 shows the diameter of the rubbing surface 12 hours after the start of heating.

The high-temperature wear resistance and load carrying capacity of the lubricating oil composition Y of Example 9 were evaluated in the same manner as in Example 1. The results are shown in Table 2.

Comparative Example 8

The lubricating oil composition Y of Comparative Example 7 was prepared in the same manner as in Example 9 except that the fullerene solution was not heated.

A fullerene adduct was confirmed in the same manner as in Example 1. The results are shown in Table 2.

The wear resistance of the lubricating oil composition Y of Comparative Example 8 was evaluated in the same manner as in Example 1. Table 2 shows the diameter of the rubbing surface 12 hours after the start of heating.

The high-temperature wear resistance and load carrying capacity of the lubricating oil composition Y of Comparative Example 8 were evaluated in the same manner as in Example 1. The results are shown in Table 2.

Example 10

The lubricating oil composition Y of Example 10 was prepared in the same manner as in Example 1, except that 95 g of a mixture of benzene (Manufactured by Tokyo Chemical Industry Co., Ltd.) and butanol (Manufactured by Tokyo Chemical Industry Co., Ltd.) in a mass ratio of 4:1 was used as a base oil, 5 g of methylphenyl silicone oil (KF-56, manufactured by Shin-Etsu Chemical Co., Ltd.) was used as a reactive component, and the fullerene solution was heated at 200° C. for 6 hours to remove the volatiles to obtain the lubricating oil composition X, and that concentrated lubricating oil composition X was added to 10 g of methylphenyl silicone oil (KF-56, manufactured by Shin-Etsu Chemical Co., Ltd.) to obtain the lubricating oil composition Y.

A fullerene adduct was confirmed in the same manner as in Example 1. The results are shown in Table 2.

The wear resistance of the lubricating oil composition Y of Example 10 was evaluated. Table 2 shows the diameter of the rubbing surface 12 hours after the start of heating.

The high-temperature wear resistance and load carrying capacity of the lubricating oil composition Y of Example 10 were evaluated in the same manner as in Example 1. The results are shown in Table 2.

Comparative Example 9

A lubricating oil composition Y of Comparative Example 9 was prepared in the same manner as in Example 10 except that the fullerene solution was not heated.

A fullerene adduct was confirmed in the same manner as in Example 1. The results are shown in Table 2.

The wear resistance of the lubricating oil composition Y of Comparative Example 9 was evaluated in the same manner as in Example 1. Table 2 shows the diameter of the rubbing surface 12 hours after the start of heating.

The high-temperature wear resistance and load carrying capacity of the lubricating oil composition Y of Comparative Example 9 were evaluated in the same manner as in Example 1. The results are shown in Table 2.

Example 11

The lubricating oil composition Y of Example 11 was prepared in the same manner as in Example 10 except that 5 g of dimethyl silicone oil (KF96-100cs, manufactured by Shin-Etsu Chemical Co., Ltd.) was used as the reactive component, and concentrated lubricating oil composition X was added to 10 g of dimethyl silicone oil (KF96-100cs, manufactured by. Shin-Etsu Chemical Co., Ltd.) to obtain lubricating oil composition Y.

A fullerene adduct was confirmed in the same manner as in Example 1. The results are shown in Table 2.

The wear resistance of the lubricating oil composition Y of Example 11 was evaluated Table 2 shows the diameter of the rubbing surface 12 hours after the start of heating.

The high-temperature wear resistance and load carrying capacity of the lubricating oil composition Y of Example 11 were evaluated in the same manner as in Example 1. The results are shown in Table 2.

Comparative Example 10

A lubricating oil composition Y of Comparative Example 10 was prepared in the same manner as in Example 11 except that the fullerene solution was not heated.

A fullerene adduct was confirmed in the same manner as in Example 1. The results are shown in Table 2.

The wear resistance of the lubricating oil composition Y of Comparative Example 10 was evaluated in the same manner as in Example 1. Table 2 shows the diameter of the rubbing surface 12 hours after the start of heating.

The high-temperature wear resistance and load carrying capacity of the lubricating oil composition Y of Comparative Example 10 were evaluated in the same manner as in Example 1. The results are shown in Table 2.

TABLE 1

| | | Example Fullerene concentration [ppm by mass] | Comparative example Fullerene concentration [ppm by mass] |
|---|---|---|---|
| Heating | 0 | 1060 | 1060 |
| Time | 1.5 | 1033 | 770 |
| [hr] | 5 | 958 | 258 |
| | 12 | 834 | 0 |
| | 19 | 595 | 0 |
| | 29 | 305 | 0 |
| | 37 | 32 | 0 |

TABLE 2

| | Lubricating oil composition No | | | | | | | | Evaluation of lubricating oil composition Y | | |
|---|---|---|---|---|---|---|---|---|---|---|---|
| | Base oil | Fullerene | Reactive component | Aging Temperature [° C.] × time [hr] | Aging (Heat treatment) Nitrogen substitution | Concen-tration | Fullerene adduct confirmation | Diluent oil | Wear [μm] | High temperature wear resistance | Load carrying capacity [kN] |
| Example 1 | TMB | $C_{60}$ | No (TMB) | 140 × 12 | Yes | 1/10 | Yes | Mineral oil A | 220 | — | — |
| Com. Example 1 | TMB | $C_{60}$ | No (TMB) | 140 × 12 ($O_2$ Present) | — | 1/10 | No | Mineral oil A | 265 | — | — |
| Com. Example 2 | TMB | $C_{60}$ | No (TMB) | — | Yes | 1/10 | No | Mineral oil A | 240 | — | — |
| Com. Example 3 | TMB | No | No (TMB) | 140 × 12 | Yes | 1/10 | No | Mineral oil A | 280 | — | — |
| Example 2 | Mineral oil A | $C_{60}$ | TMB | 140 × 12 | Yes | No | Yes | Mineral oil A | 220 | — | — |
| Example 3 | Mineral oil A | $C_{70}$ | TMB | 140 × 12 | Yes | No | Yes | Mineral oil A | 225 | — | — |
| Example 4 | Mineral oil A | Mixed fullerene | TMB | 140 × 12 | Yes | No | Yes | Mineral oil A | 223 | — | — |
| Example 5 | Decalin | $C_{60}$ | No | 160 × 12 | Yes | Volatile | Yes | PAO | 210 | — | 10 |
| Com. Example 4 | Decalin | $C_{60}$ | No | — | — | Volatile | No | PAO | 230 | — | 7 |
| Example 6 | Toluene | $C_{60}$ | DMC | 150 × 12 | Yes | Volatile | Yes | Mineral oil A | 217 | — | 9 |
| Com. Example 5 | Toluene | $C_{60}$ | DMC | — | — | Volatile | No | Mineral oil A | 240 | — | 4 |
| Example 7 | Benzene | $C_{60}$ | DTE | 160 × 12 | Yes | Volatile | Yes | POE-A | 235 | — | 7 |
| Com. Example 6 | Benzene | $C_{60}$ | DTE | — | — | Volatile | No | POE-A | 250 | — | 5 |
| Example 8 | POE-A | $C_{60}$ | No | 150 × 12 | Yes | No | Yes | No | 240 | — | 10 |

TABLE 2-continued

| | Lubricating oil composition No | | | | | | | | Evaluation of lubricating oil composition Y | | |
|---|---|---|---|---|---|---|---|---|---|---|---|
| | Base oil | Fullerene | Reactive component | Aging Temperature [° C.] × time [hr] | Aging (Heat treatment) Nitrogen substitution | Concen-tration | Fullerene adduct confirmation | Diluent oil | Wear [μm] | High temperature wear resistance | Load carrying capacity [kN] |
| Com. Example 7 | POE-A | $C_{60}$ | No | — | — | No | No | No | 250 | — | 5 |
| Example 9 | POE-B | $C_{60}$ | No | 150 × 12 | Yes | No | Yes | No | 235 | — | 7 |
| Com. Example 8 | POE-B | $C_{60}$ | No | — | — | No | No | No | 245 | — | 4 |
| Example 10 | Benzene/ Butanol = 4:1 | $C_{60}$ | KF56 | 200 × 6 | Yes | Volatile | Yes | KF56 | 260 | 270 | — |
| Com. Example 9 | Benzene/ Butanol = 4:1 | $C_{60}$ | KF56 | — | — | Volatile | No | KF56 | 265 | 285 | — |
| Example 11 | Benzene/ Butanol = 4:1 | $C_{60}$ | KF96-100 cs | 200 × 6 | Yes | Volatile | Yes | KF96-100 cs | 280 | 275 | — |
| Com. Example 10 | Benzene/ Butanol = 4:1 | $C_{60}$ | KF96-101 cs | — | — | Volatile | No | KF96-100 cs | 275 | 290 | — |

From the results of Table 1 and FIG. 1, it was found that in Example 1, which was heat-treated in a nitrogen atmosphere, fullerenes almost disappeared 37 hours after the start of heating. On the other hand, in Comparative Example 1 subjected to heat treatment in an atmosphere, it was found that fullerenes almost disappeared within 12 hours after the start of heating.

From the results of Table 2, it was found that Examples 1 to 11 had better wear resistance than the corresponding Comparative Examples 1 to 10.

From the results of Table 2, it was found that Examples 5 to 9 had better load carrying capacity than the corresponding Comparative Examples 4 to 8.

From the results of Table 2, it was found that Example 10 and Example 11 had better high-temperature wear resistance than the corresponding Comparative Examples 9 and 10.

As a result of confirming the fullerene adduct with respect to the lubricating oil composition X of the embodiment recovered 12 hours after the start of heating, the peak of the mass 720 derived from the fullerene and the peak of the mass 958 were confirmed in Example 1. The peak intensity of mass 958 relative to the peak intensity of mass 720 was about 1/10. The peak of mass 958 is the mass of fullerene+(mass of 1,2,4-Trimethylbenzene−mass of the hydrogen atom)×2. Therefore, it was determined that two 1,2,4-trimethylbenzene radicals were added to one fullerene to form a fullerene adduct.

In addition, 21% of fullerenes were lost and 79% remained, indicating that about half (that's 100 ppm) of the lost fullerenes were converted into fullerene adducts.

Similarly, regarding the lubricating oil composition X of Comparative Example 1 recovered 12 hours after the start of heating, as a result of confirmation of the fullerene adduct, no peak was observed in the range of mass 700 to mass 2000. That is, it was found that the fullerene adduct was not formed in Comparative Example 1.

Based on the results of the evaluation of the wear resistance, it is considered that the fullerene adduct prepared by adding 1,2,4-trimethylbenzene to fullerene, which is completely mixed with mineral oil, has high compatibility with mineral oil, and the wear resistance of the lubricating oil composition Y of Examples 1 to 4 has been improved.

Example 12

(Synthesis of Reactive Components)

Butanol (NC4, manufactured by Tokyo Chemical Industry Co., Ltd.), 3.0 g and 7.5 g of sodium iodide (Manufactured by Tokyo Chemical Industry Co., Ltd.) were charged into a 250 mL eggplant flask.

To the eggplant flask was added 50 mL of acetonitrile (Manufactured by Tokyo Chemical Industry Co., Ltd.).

While the inside of the eggplant flask was filled with nitrogen gas, 5.4 g of chlorotrimethylsilane (Manufactured by Tokyo Chemical Industry Co., Ltd.) was added.

In this state, a mixed solution of butanol, sodium iodide, acetonitrile and chlorotrimethylsilane was stirred for 2 hours, and then 100 mL of diethyl ether (Manufactured by Tokyo Chemical Industry Co., Ltd.) was added to an eggplant flask to obtain a precipitate.

The resulting precipitate was filtered off and washed with water.

The washed precipitate was charged into a 250 mL eggplant flask, and 50 mL of acetone (Manufactured by Tokyo Chemical Industry Co., Ltd.) and 6.8 g of hydroxycumene (CmIP manufactured by Tokyo Chemical Industry Co., Ltd.) were added.

After refluxing the mixed solution of the precipitate, acetone and hydroxycumene for 96 hours, acetone was distilled off from the mixed solution using a rotary evaporator.

To the mixture obtained by distilling off the acetone, 100 mL of toluene (Manufactured by Tokyo Chemical Industry Co., Ltd.) was added to make a solution.

The above solution was washed 3 times with 50 mL of 10% aqueous sodium hydroxide (Manufactured by Tokyo Chemical Industry Co., Ltd.) solution.

Toluene was evaporated from the solution using a rotary evaporator to give a cumene derivative (reactive component).

(Preparation of Composition Solution)

As a base oil, 100 g of toluene (Manufactured by Tokyo Chemical Industry Co., Ltd.), 0.1 g (100 mg) of a fullerene raw material ($C_{60}$, nanom (registered trademark) NP-SUH, manufactured by Frontier Carbon Co., Ltd.) and 0.53 g of the above cumene derivative (reactive component) were mixed and stirred at room temperature for 3 hours using a stirrer to prepare a solution of a mixture of a base oil, fullerene and a reactive component (fullerene solution). The resulting fullerene solution was determined to contain 1000 ppm of fullerene by measuring the concentration of fullerene by the HPLC method in the same manner as in Example 1.

The fullerene solution was then transferred to a 250 mL stainless pressure vessel and capped. A gas introduction part and an exhaust part are attached to the lid so as to replace the gas in the container.

Next, nitrogen was injected into the pressure-resistant container at a flow rate of 0.2 L per minute from the gas introducing portion attached to the lid, and the pressure-resistant container was allowed to stand in this state for 10 minutes, and then the gas introducing portion and the exhaust portion were closed to make the pressure-resistant container interior a nitrogen atmosphere.

Next, the pressure vessel was immersed in an oil bath at 140° C. and held for 16 hours to heat the fullerene solution, and then the pressure vessel was taken out of the oil bath and allowed to cool to room temperature to obtain a composition solution.

The concentration of fullerenes in the raw material of the composition solution was determined by HPLC in the same manner as in Example 1, and it was confirmed that the concentration was in the range of 10 ppm to 500 ppm. A fullerene adduct was detected from a mass detector.

From this, it was confirmed that a part of the raw material fullerene reacted with the reactive component by heating to form the fullerene adduct.

10 g of the composition solution was collected and the volatile components of the composition solution were evaporated using a rotary evaporator to obtain 1 g of a concentrated composition solution X.

The fullerene adduct was confirmed with the composition solution X in the same manner as in Example 1. The results are shown in Table 3.

(Preparation and Evaluation of Lubricating Oil Composition)

Next, 1 g of the composition solution X and 20 g of mineral oil A were mixed and stirred with a stirrer for 6 hours at room temperature.

The resulting mixture was then filtered through a 0.1 μm mesh membrane filter to give the lubricating oil composition Y.

The high-temperature wear resistance and load carrying capacity of the lubricating oil composition Y of Example 12 were evaluated in the same manner as in Example 1. The results are shown in Table 3.

Comparative Example 111

A lubricating oil composition Y of Comparative Example 11 was prepared in the same manner as in Example 12 except that the fullerene solution was not heated.

A fullerene adduct was confirmed in the composition solution in the same manner as in Example 1. The results are shown in Table 3.

The wear resistance of the lubricating oil composition Y of Comparative Example 11 was evaluated in the same manner as in Example 1. Table 3 shows the diameter of the rubbing surface 12 hours after the start of heating.

The high-temperature wear resistance and load carrying capacity of the lubricating oil composition Y of Comparative Example 11 were evaluated in the same manner as in Example 1. The results are shown in Table 3.

Example 13

(Synthesis of Reactive Components)

A cumene derivative (reactive component) was obtained in the same manner as in Example 12, except that 3.5 g of 3 methyl-1-butanol (IC5, manufactured by Tokyo Chemical Industry Co., Ltd.) was used instead of 3.0 g of butanol (NC4, manufactured by Tokyo Chemical Industry Co., Ltd.).

(Preparation of Composition Solution) A composition solution X was obtained in the same manner as in Example 12, except that 0.57 g of the cumene derivative obtained in Example 13 (reactive component) was used instead of 0.53 g of the cumene derivative obtained in Example 12 (reactive component).

The fullerene adduct was confirmed with the composition solution X in the same manner as in Example 1. The results are shown in Table 3.

(Preparation and Evaluation of Lubricating Oil Composition)

A lubricating oil composition Y was obtained in the same manner as in Example 12 except that the composition solution X obtained in Example 13 was used.

The high-temperature wear resistance and load carrying capacity of the lubricating oil composition Y of Example 13 were evaluated in the same manner as in Example 1. The results are shown in Table 3.

Comparative Example 12

A lubricating oil composition Y of Comparative Example 12 was prepared in the same manner as in Example 13 except that the fullerene solution was not heated.

A fullerene adduct was confirmed in the composition solution in the same manner as in Example 1. The results are shown in Table 3.

The wear resistance of the lubricating oil composition Y of Comparative Example 12 was evaluated in the same manner as in Example 1. Table 3 shows the diameter of the rubbing surface 12 hours after the start of heating.

The high-temperature wear resistance and load carrying capacity of the lubricating oil composition Y of Comparative Example 12 were evaluated in the same manner as in Example 1. The results are shown in Table 3.

Example 14

(Synthesis of Reactive Components)

A cumene derivative (reactive component) was obtained in the same manner as in Example 12, except that 6.3 g of 1 decanol (NC10 manufactured by Tokyo Chemical Industry Co., Ltd.) was used instead of 3.0 g of butanol (NC4, manufactured by Tokyo Chemical Industry Co., Ltd.).

(Preparation of Composition Solution)

A composition solution X was obtained in the same manner as in Example 12, except that 0.77 g of the cumene derivative obtained in Example 14 (reactive component) was used instead of 0.53 g of the cumene derivative obtained in Example 12 (reactive component).

The fullerene adduct was confirmed with the composition solution X in the same manner as in Example 1. The results are shown in Table 3.

(Preparation and Evaluation of Lubricating Oil Composition)

A lubricating oil composition Y was obtained in the same manner as in Example 12 except that the composition solution X obtained in Example 14 was used.

The high-temperature wear resistance and load carrying capacity of the lubricating oil composition Y of Example 14 were evaluated in the same manner as in Example 1. The results are shown in Table 3.

Comparative Example 13

A lubricating oil composition Y of Comparative Example 13 was prepared in the same manner as in Example 14 except that the fullerene solution was not heated.

A fullerene adduct was confirmed in the composition solution in the same manner as in Example 1. The results are shown in Table 3.

The wear resistance of the lubricating oil composition Y of Comparative Example 13 was evaluated in the same manner as in Example 1. Table 3 shows the diameter of the rubbing surface 12 hours after the start of heating.

The high-temperature wear resistance and load carrying capacity of the lubricating oil composition Y of Comparative Example 13 were evaluated in the same manner as in Example 1. The results are shown in Table 3.

Example 15

(Synthesis of Reactive Components) A cumene derivative (reactive component) was obtained in the same manner as in Example 14, except that 7.5 g of hydroxycumene (CmIB, manufactured by Tokyo Chemical Industry Co., Ltd.) was used instead of 6.8 g of hydroxycumene (CmIP manufactured by Tokyo Chemical Industry Co., Ltd.).

(Preparation of Composition Solution)

A composition solution X was obtained in the same manner as in Example 12, except that 0.81 g of the cumene derivative obtained in Example 15 (reactive component) was used instead of 0.53 g of the cumene derivative obtained in Example 12 (reactive component).

The fullerene adduct was confirmed with the composition solution X in the same manner as in Example 1. The results are shown in Table 3.

(Preparation and Evaluation of Lubricating Oil Composition)

A lubricating oil composition Y was obtained in the same manner as in Example 12 except that the composition solution X obtained in Example 15 was used.

The high-temperature wear resistance and load carrying capacity of the lubricating oil composition Y of Example 15 were evaluated in the same manner as in Example 1. The results are shown in Table 3.

Comparative Example 14

A lubricating oil composition Y of Comparative Example 14 was prepared in the same manner as in Example 15 except that the fullerene solution was not heated.

A fullerene adduct was confirmed in the composition solution in the same manner as in Example 1. The results are shown in Table 3.

The wear resistance of the lubricating oil composition Y of Comparative Example 14 was evaluated in the same manner as in Example 1. Table 3 shows the diameter of the rubbing surface 12 hours after the start of heating.

The high-temperature wear resistance and load carrying capacity of the lubricating oil composition Y of Comparative Example 14 were evaluated in the same manner as in Example 1. The results are shown in Table 3.

Example 16

(Synthesis of Reactive Components)

A cumene derivative (reactive component) was obtained in the same manner as in Example 14, except that 8.8 g of hydroxycumene (CmCy, manufactured by Tokyo Chemical Industry Co., Ltd.) was used instead of 6.8 g of hydroxycumene (CmIP manufactured by Tokyo Chemical Industry Co., Ltd.).

(Preparation of Composition Solution)

A composition solution X was obtained in the same manner as in Example 12, except that 0.88 g of the cumene derivative obtained in Example 16 (reactive component) was used instead of 0.53 g of the cumene derivative obtained in Example 12 (reactive component).

The fullerene adduct was confirmed with the composition solution X in the same manner as in Example 1. The results are shown in Table 3.

(Preparation and Evaluation of Lubricating Oil Composition)

A lubricating oil composition Y was obtained in the same manner as in Example 12 except that the composition solution X obtained in Example 16 was used.

The high-temperature wear resistance and load carrying capacity of the lubricating oil composition Y of Example 16 were evaluated in the same manner as in Example 1. The results are shown in Table 3.

Comparative Example 15

A lubricating oil composition Y of Comparative Example 15 was prepared in the same manner as in Example 16 except that the fullerene solution was not heated.

A fullerene adduct was confirmed in the composition solution in the same manner as in Example 1. The results are shown in Table 3.

The wear resistance of the lubricating oil composition Y of Comparative Example 15 was evaluated in the same manner as in Example 1. Table 3 shows the diameter of the rubbing surface 12 hours after the start of heating.

The high-temperature wear resistance and load carrying capacity of the lubricating oil composition Y of Comparative Example 15 were evaluated in the same manner as in Example 1. The results are shown in Table 3.

Example 17

(Synthesis of Reactive Components)

A cumene derivative (reactive component) was obtained in the same manner as in Example 12, except that 13.1 g of biphenyl alcohol (NC 22 manufactured by Tokyo Chemical Industry Co., Ltd.) was used instead of 3.0 g of butanol (NC4, manufactured by Tokyo Chemical Industry Co., Ltd.).

(Preparation of Composition Solution)

A composition solution X was obtained in the same manner as in Example 12, except that 1.24 g of the cumene derivative obtained in Example 17 (reactive component) was used instead of 0.53 g of the cumene derivative obtained in Example 12 (reactive component).

The fullerene adduct was confirmed with the composition solution X in the same manner as in Example 1. The results are shown in Table 3.

(Preparation and Evaluation of Lubricating Oil Composition)

A lubricating oil composition Y was obtained in the same manner as in Example 12, except that the composition solution X obtained in Example 17 and poly-α-olefin (PAO, manufactured by JX Nippon Steel Nisseki Co., Ltd.) were used instead of mineral oil A.

The high-temperature wear resistance and load carrying capacity of the lubricating oil composition Y of Example 17 were evaluated in the same manner as in Example 1. The results are shown in Table 3.

Comparative Example 16

A lubricating oil composition Y of Comparative Example 16 was prepared in the same manner as in Example 17 except that the fullerene solution was not heated.

A fullerene adduct was confirmed in the composition solution in the same manner as in Example 1. The results are shown in Table 3.

The wear resistance of the lubricating oil composition Y of Comparative Example 16 was evaluated in the same manner as in Example 1. Table 3 shows the diameter of the rubbing surface 12 hours after the start of heating.

The high-temperature wear resistance and load carrying capacity of the lubricating oil composition Y of Comparative Example 16 were evaluated in the same manner as in Example 1. The results are shown in Table 3.

Example 18

(Synthesis of Reactive Components)

Cumene derivative (reactive component) was obtained in the same manner as in Example 12, except that 5.9 g of dipropylene glycol monomethyl ether (P2GME, manufactured by Tokyo Chemical Industry Co., Ltd.) was used instead of 3.0 g of butanol (NC4, manufactured by Tokyo Chemical Industry Co., Ltd.), and tetrahydrofuran (THF, manufactured by Tokyo Chemical Industry Co., Ltd.) was used instead of toluene as the solvent to be added to the mixture by distillation of acetone.

(Preparation of Composition Solution)

A composition solution X was obtained in the same manner as in Example 12, except that 0.74 g of the cumene derivative obtained in Example 18 (reactive component) was used instead of 0.53 g of the cumene derivative obtained in Example 12 (reactive component).

The fullerene adduct was confirmed with the composition solution X in the same manner as in Example 1. The results are shown in Table 3.

(Preparation and Evaluation of Lubricating Oil Composition)

A lubricating oil composition Y was obtained in the same manner as in Example 12, except that the composition solution X obtained in Example 18 and polyol ester (POE-A, polyol ester type, Unister™ H-334 R, manufactured by NOF Corporation) were used instead of mineral oil A.

The high-temperature wear resistance and load carrying capacity of the lubricating oil composition Y of Example 18 were evaluated in the same manner as in Example 1. The results are shown in Table 3.

Comparative Example 17

A lubricating oil composition Y of Comparative Example 17 was prepared in the same manner as in Example 18 except that the fullerene solution was not heated.

A fullerene adduct was confirmed in the composition solution in the same manner as in Example 1. The results are shown in Table 3.

The wear resistance of the lubricating oil composition Y of Comparative Example 17 was evaluated in the same manner as in Example 1. Table 3 shows the diameter of the rubbing surface 12 hours after the start of heating.

The high-temperature wear resistance and load carrying capacity of the lubricating oil composition Y of Comparative Example 17 were evaluated in the same manner as in Example 1. The results are shown in Table 3.

Example 19

(Synthesis of Reactive Components)

A cumene derivative (reactive component) was obtained in the same manner as in Example 18, except that 8.3 g of tripropylene glycol monomethyl ether (P3GME, manufactured by Tokyo Chemical Industry Co., Ltd.) was used instead of 3.0 g of butanol (NC4, manufactured by Tokyo Chemical Industry Co., Ltd.).

(Preparation of Composition Solution)

A composition solution X was obtained in the same manner as in Example 12, except that 0.90 g of the cumene derivative obtained in Example 19 (reactive component) was used instead of 0.53 g of the cumene derivative obtained in Example 12 (reactive component).

The fullerene adduct was confirmed with the composition solution X in the same manner as in Example 1. The results are shown in Table 3.

(Preparation and Evaluation of Lubricating Oil Composition)

A lubricating oil composition Y was obtained in the same manner as in Example 18 except that the composition solution X obtained in Example 19 was used.

The high-temperature wear resistance and load carrying capacity of the lubricating oil composition Y of Example 19 were evaluated in the same manner as in Example 1. The results are shown in Table 3.

Comparative Example 18

A lubricating oil composition Y of Comparative Example 18 was prepared in the same manner as in Example 19 except that the fullerene solution was not heated.

A fullerene adduct was confirmed in the composition solution in the same manner as in Example 1. The results are shown in Table 3.

The wear resistance of the lubricating oil composition Y of Comparative Example 18 was evaluated in the same manner as in Example 1. Table 3 shows the diameter of the rubbing surface 12 hours after the start of heating.

The high-temperature wear resistance and load carrying capacity of the lubricating oil composition Y of Comparative Example 18 were evaluated in the same manner as in Example 1. The results are shown in Table 3.

Example 20

(Synthesis of Reactive Components)

A cumene derivative (reactive component) was obtained in the same manner as in Example 19, except that 7.5 g of hydroxycumene (CmIB, manufactured by Tokyo Chemical Industry Co., Ltd.) was used instead of 6.8 g of hydroxycumene (CmIP manufactured by Tokyo Chemical Industry Co., Ltd.).

(Preparation of Composition Solution)

A composition solution X was obtained in the same manner as in Example 12, except that 0.94 g of the cumene derivative obtained in Example 20 (reactive component) was used instead of 0.53 g of the cumene derivative obtained in Example 12 (reactive component).

The fullerene adduct was confirmed with the composition solution X in the same manner as in Example 1. The results are shown in Table 3.

(Preparation and Evaluation of Lubricating Oil Composition)

A lubricating oil composition Y was obtained in the same manner as in Example 18 except that the composition solution X obtained in Example 20 was used.

The high-temperature wear resistance and load carrying capacity of the lubricating oil composition Y of Example 20 were evaluated in the same manner as in Example 1. The results are shown in Table 3.

Comparative Example 19

A lubricating oil composition Y of Comparative Example 19 was prepared in the same manner as in Example 20 except that the fullerene solution was not heated.

A fullerene adduct was confirmed in the composition solution in the same manner as in Example 1. The results are shown in Table 3.

The wear resistance of the lubricating oil composition Y of Comparative Example 19 was evaluated in the same manner as in Example 1. Table 3 shows the diameter of the rubbing surface 12 hours after the start of heating.

The high-temperature wear resistance and load carrying capacity of the lubricating oil composition Y of Comparative Example 19 were evaluated in the same manner as in Example 1. The results are shown in Table 3.

Example 21

(Synthesis of Reactive Components)

A cumene derivative (reactive component) was obtained in the same manner as in Example 19, except that 8.8 g of hydroxycumene (CmCy, manufactured by Tokyo Chemical Industry Co., Ltd.) was used instead of 6.8 g of hydroxycumene (CmIP manufactured by Tokyo Chemical Industry Co., Ltd.).

(Preparation of Composition Solution) A composition solution X was obtained in the same manner as in Example 12, except that 1.0 g of the cumene derivative obtained in Example 21 (reactive component) was used instead of 0.53 g of the cumene derivative obtained in Example 12 (reactive component).

The fullerene adduct was confirmed with the composition solution X in the same manner as in Example 1. The results are shown in Table 3.

(Preparation and Evaluation of Lubricating Oil Composition)

A lubricating oil composition Y was obtained in the same manner as in Example 18 except that the composition solution X obtained in Example 21 was used.

The high-temperature wear resistance and load carrying capacity of the lubricating oil composition Y of Example 21 were evaluated in the same manner as in Example 1. The results are shown in Table 3.

Comparative Example 20

A lubricating oil composition Y of Comparative Example 20 was prepared in the same manner as in Example 21 except that the fullerene solution was not heated.

A fullerene adduct was confirmed in the composition solution in the same manner as in Example 1. The results are shown in Table 3.

The wear resistance of the lubricating oil composition Y of Comparative Example 20 was evaluated in the same manner as in Example 1. Table 3 shows the diameter of the rubbing surface 12 hours after the start of heating.

The high-temperature wear resistance and load carrying capacity of the lubricating oil composition Y of Comparative Example 20 were evaluated in the same manner as in Example 1. The results are shown in Table 3.

Example 22

(Synthesis of Reactive Components)

A cumene derivative (reactive component) was obtained in the same manner as in Example 18, except that 7.9 g of diethylene glycol monobenzyl ether (E2GBE, manufactured by Tokyo Chemical Industry Co., Ltd.) was used instead of 3.0 g of butanol (NC4, manufactured by Tokyo Chemical Industry Co., Ltd.).

(Preparation of Composition Solution)

A composition solution X was obtained in the same manner as in Example 12, except that 0.87 g of the cumene derivative obtained in Example 22 (reactive component) was used instead of 0.53 g of the cumene derivative obtained in Example 12 (reactive component).

The fullerene adduct was confirmed with the composition solution X in the same manner as in Example 1. The results are shown in Table 3.

(Preparation and Evaluation of Lubricating Oil Composition)

A lubricating oil composition Y was obtained in the same manner as in Example 18 except that the composition solution X obtained in Example 22 was used.

The high-temperature wear resistance and load carrying capacity of the lubricating oil composition Y of Example 22 were evaluated in the same manner as in Example 1. The results are shown in Table 3.

Comparative Example 21

A lubricating oil composition Y of Comparative Example 21 was prepared in the same manner as in Example 22 except that the fullerene solution was not heated.

A fullerene adduct was confirmed in the composition solution in the same manner as in Example 1. The results are shown in Table 3.

The wear resistance of the lubricating oil composition Y of Comparative Example 21 was evaluated in the same manner as in Example 1. Table 3 shows the diameter of the rubbing surface 12 hours after the start of heating.

The high-temperature wear resistance and load carrying capacity of the lubricating oil composition Y of Comparative Example 21 were evaluated in the same manner as in Example 1. The results are shown in Table 3.

Example 23

(Synthesis of Reactive Components)

A cumene derivative (reactive component) was obtained in the same manner as in Example 18, except that 5.4 g of diethylene glycol monoethyl ether (E2GEE, manufactured by Tokyo Chemical Industry Co., Ltd.) was used instead of 3.0 g of butanol (NC4, manufactured by Tokyo Chemical Industry Co., Ltd.).

(Preparation of Composition Solution)

A composition solution X was obtained in the same manner as in Example 12, except that 0.70 g of the cumene derivative obtained in Example 23 (reactive component) was used instead of 0.53 g of the cumene derivative obtained in Example 12 (reactive component).

The fullerene adduct was confirmed with the composition solution X in the same manner as in Example 1. The results are shown in Table 4.

(Preparation and Evaluation of Lubricating Oil Composition)

A lubricating oil composition Y was obtained in the same manner as in Example 18 except that the composition solution X obtained in Example 23 was used.

The high-temperature wear resistance and load carrying capacity of the lubricating oil composition Y of Example 23 were evaluated in the same manner as in Example 1. The results are shown in Table 4.

Comparative Example 22

A lubricating oil composition Y of Comparative Example 22 was prepared in the same manner as in Example 23 except that the fullerene solution was not heated.

A fullerene adduct was confirmed in the composition solution in the same manner as in Example 1. The results are shown in Table 4.

The wear resistance of the lubricating oil composition Y of Comparative Example 22 was evaluated in the same manner as in Example 1. Table 4 shows the diameter of the rubbing surface 12 hours after the start of heating.

The high-temperature wear resistance and load carrying capacity of the lubricating oil composition Y of Comparative Example 22 were evaluated in the same manner as in Example 1. The results are shown in Table 4.

Example 24

(Synthesis of Reactive Components)

A cumene derivative (reactive component) was obtained in the same manner as in Example 18, except that 13.6 g of heptaethylene glycol monomethyl ether (E6GME, manufactured by Tokyo Chemical Industry Co., Ltd.) was used instead of 3.0 g of butanol (NC4, manufactured by Tokyo Chemical Industry Co., Ltd.).

(Preparation of Composition Solution)

A composition solution X was obtained in the same manner as in Example 12, except that 1.27 g of the cumene derivative obtained in Example 24 (reactive component) was used instead of 0.53 g of the cumene derivative obtained in Example 12 (reactive component).

The fullerene adduct was confirmed with the composition solution X in the same manner as in Example 1. The results are shown in Table 4.

(Preparation and Evaluation of Lubricating Oil Composition)

A lubricating oil composition Y was obtained in the same manner as in Example 18 except that the composition solution X obtained in Example 24 was used.

The high-temperature wear resistance and load carrying capacity of the lubricating oil composition Y of Example 24 were evaluated in the same manner as in Example 1. The results are shown in Table 4.

Comparative Example 23

A lubricating oil composition Y of Comparative Example 23 was prepared in the same manner as in Example 24 except that the fullerene solution was not heated.

A fullerene adduct was confirmed in the composition solution in the same manner as in Example 1. The results are shown in Table 4.

The wear resistance of the lubricating oil composition Y of Comparative Example 23 was evaluated in the same manner as in Example 1. Table 4 shows the diameter of the rubbing surface 12 hours after the start of heating.

The high-temperature wear resistance and load carrying capacity of the lubricating oil composition Y of Comparative Example 23 were evaluated in the same manner as in Example 1. The results are shown in Table 4.

Example 25

(Synthesis of Reactive Components)

A cumene derivative (reactive component) was obtained in the same manner as in Example 18, except that 14.9 g of hexaethylene glycol monobenzyl ether (E6GBE, manufactured by Tokyo Chemical Industry Co., Ltd.) was used instead of 3.0 g of butanol (NC4, manufactured by Tokyo Chemical Industry Co., Ltd.).

(Preparation of Composition Solution)

A composition solution X was obtained in the same manner as in Example 12, except that 1.36 g of the cumene derivative obtained in Example 25 (reactive component) was used instead of 0.53 g of the cumene derivative obtained in Example 12 (reactive component).

The fullerene adduct was confirmed with the composition solution X in the same manner as in Example 1. The results are shown in Table 4.

(Preparation and Evaluation of Lubricating Oil Composition)

A lubricating oil composition Y was obtained in the same manner as in Example 18 except that the composition solution X obtained in Example 25 was used.

The high-temperature wear resistance and load carrying capacity of the lubricating oil composition Y of Example 25 were evaluated in the same manner as in Example 1. The results are shown in Table 4.

Comparative Example 24

A lubricating oil composition Y of Comparative Example 24 was prepared in the same manner as in Example 25 except that the fullerene solution was not heated.

A fullerene adduct was confirmed in the composition solution in the same manner as in Example 1. The results are shown in Table 4.

The wear resistance of the lubricating oil composition Y of Comparative Example 24 was evaluated in the same manner as in Example 1. Table 4 shows the diameter of the rubbing surface 12 hours after the start of heating.

The high-temperature wear resistance and load carrying capacity of the lubricating oil composition Y of Comparative Example 24 were evaluated in the same manner as in Example 1. The results are shown in Table 4.

Example 26

(Synthesis of Reactive Components)

A cumene derivative (reactive component) was obtained in the same manner as in Example 18, except that 11.1 g of tert-butyl 12-hydroxy-4,7,10-trioxadodecanoate (E3GBS, manufactured by Tokyo Chemical Industry Co., Ltd.) was used instead of 3.0 g of butanol (NC4, manufactured by Tokyo Chemical Industry Co., Ltd.).

(Preparation of Composition Solution)

A composition solution X was obtained in the same manner as in Example 12, except that 1.1 g of the cumene derivative obtained in Example 26 (reactive component) was used instead of 0.53 g of the cumene derivative obtained in Example 12 (reactive component).

The fullerene adduct was confirmed with the composition solution X in the same manner as in Example 1. The results are shown in Table 4.

(Preparation and Evaluation of Lubricating Oil Composition)

A lubricating oil composition Y was obtained in the same manner as in Example 18 except that the composition solution X obtained in Example 26 was used.

The high-temperature wear resistance and load carrying capacity of the lubricating oil composition Y of Example 26 were evaluated in the same manner as in Example 1. The results are shown in Table 4.

Comparative Example 25

A lubricating oil composition Y of Comparative Example 25 was prepared in the same manner as in Example 26 except that the fullerene solution was not heated.

A fullerene adduct was confirmed in the composition solution in the same manner as in Example 1. The results are shown in Table 4.

The wear resistance of the lubricating oil composition Y of Comparative Example 25 was evaluated in the same manner as in Example 1. Table 4 shows the diameter of the rubbing surface 12 hours after the start of heating.

The high-temperature wear resistance and load carrying capacity of the lubricating oil composition Y of Comparative Example 25 were evaluated in the same manner as in Example 1. The results are shown in Table 4.

Example 27

(Synthesis of Reactive Components)

Cumene derivatives (reactive component) were obtained in the same manner as in Example 12, except that 4.2 g of ethyl glycolate (GgaE, manufactured by Tokyo Chemical Industry Co., Ltd.) was used instead of 3.0 g of butanol (NC4, manufactured by Tokyo Chemical Industry Co., Ltd.), and acetonitrile (Manufactured by Tokyo Chemical Industry Co., Ltd.) was used instead of toluene as the solvent to be added to the mixture from which acetone was distilled off.

(Preparation of Composition Solution)

A composition solution X was obtained in the same manner as in Example 12, except that 0.62 g of the cumene derivative obtained in Example 27 (reactive component) was used instead of 0.53 g of the cumene derivative obtained in Example 12 (reactive component).

The fullerene adduct was confirmed with the composition solution X in the same manner as in Example 1. The results are shown in Table 4.

(Preparation and Evaluation of Lubricating Oil Composition)

A lubricating oil composition Y was obtained in the same manner as in Example 12, except that the composition solution X obtained in Example 27 and monoester (POE-B, monoester type, Unister™ MB-881, manufactured by NOF Corporation) were used instead of mineral oil A.

The high-temperature wear resistance and load carrying capacity of the lubricating oil composition Y of Example 27 were evaluated in the same manner as in Example 1. The results are shown in Table 4.

Comparative Example 26

A lubricating oil composition Y of Comparative Example 26 was prepared in the same manner as in Example 27 except that the fullerene solution was not heated.

A fullerene adduct was confirmed in the composition solution in the same manner as in Example 1. The results are shown in Table 4.

The wear resistance of the lubricating oil composition Y of Comparative Example 26 was evaluated in the same manner as in Example 1. Table 4 shows the diameter of the rubbing surface 12 hours after the start of heating.

The high-temperature wear resistance and load carrying capacity of the lubricating oil composition Y of Comparative Example 26 were evaluated in the same manner as in Example 1. The results are shown in Table 4.

Example 28

(Synthesis of Reactive Components)

A cumene derivative (reactive component) was obtained in the same manner as in Example 27, except that 7.5 g of hydroxycumene (CmIB, manufactured by Tokyo Chemical Industry Co., Ltd.) was used instead of 6.8 g of hydroxycumene (CmIB, manufactured by Tokyo Chemical Industry Co., Ltd.).

(Preparation of Composition Solution)

A composition solution X was obtained in the same manner as in Example 27, except that 0.66 g of the cumene derivative obtained in Example 28 (reactive component) was used instead of 0.62 g of the cumene derivative obtained in Example 27 (reactive component).

The fullerene adduct was confirmed with the composition solution X in the same manner as in Example 1. The results are shown in Table 4.

(Preparation and Evaluation of Lubricating Oil Composition)

A lubricating oil composition Y was obtained in the same manner as in Example 27 except that the composition solution X obtained in Example 28 was used.

The high-temperature wear resistance and load carrying capacity of the lubricating oil composition Y of Example 28 were evaluated in the same manner as in Example 1. The results are shown in Table 4.

Comparative Example 27

A lubricating oil composition Y of Comparative Example 27 was prepared in the same manner as in Example 28 except that the fullerene solution was not heated.

A fullerene adduct was confirmed in the composition solution in the same manner as in Example 1. The results are shown in Table 4.

The wear resistance of the lubricating oil composition Y of Comparative Example 27 was evaluated in the same manner as in Example 1. Table 4 shows the diameter of the rubbing surface 12 hours after the start of heating.

The high-temperature wear resistance and load carrying capacity of the lubricating oil composition Y of Comparative Example 27 were evaluated in the same manner as in Example 1. The results are shown in Table 4.

Example 29

(Synthesis of Reactive Components)

A cumene derivative (reactive component) was obtained in the same manner as in Example 27, except that 8.8 g of hydroxycumene (CmCy, manufactured by Tokyo Chemical Industry Co., Ltd.) was used instead of 6.8 g of hydroxycumene (CmIP manufactured by Tokyo Chemical Industry Co., Ltd.).

(Preparation of Composition Solution)

A composition solution X was obtained in the same manner as in Example 27, except that 0.73 g of the cumene derivative obtained in Example 29 (reactive component) was used instead of 0.62 g of the cumene derivative obtained in Example 27 (reactive component).

The fullerene adduct was confirmed with the composition solution X in the same manner as in Example 1. The results are shown in Table 4.

(Preparation and Evaluation of Lubricating Oil Composition)

A lubricating oil composition Y was obtained in the same manner as in Example 27 except that the composition solution X obtained in Example 29 was used.

The high-temperature wear resistance and load carrying capacity of the lubricating oil composition Y of Example 29 were evaluated in the same manner as in Example 1. The results are shown in Table 4.

Comparative Example 28

A lubricating oil composition Y of Comparative Example 28 was prepared in the same manner as in Example 29 except that the fullerene solution was not heated.

A fullerene adduct was confirmed in the composition solution in the same manner as in Example 1. The results are shown in Table 4.

The wear resistance of the lubricating oil composition Y of Comparative Example 28 was evaluated in the same manner as in Example 1. Table 4 shows the diameter of the rubbing surface 12 hours after the start of heating.

The high-temperature wear resistance and load carrying capacity of the lubricating oil composition Y of Comparative Example 28 were evaluated in the same manner as in Example 1. The results are shown in Table 4.

Example 30

(Synthesis of Reactive Components)

A cumene derivative (reactive component) was obtained in the same manner as in Example 27, except that 9.0 g of terephthalic acid 2-hydroxyethyl methyl ester (TpaMS manufactured by Tokyo Chemical Industry Co., Ltd.) was used instead of 3.0 g of butanol (NC4, manufactured by Tokyo Chemical Industry Co., Ltd.).

(Preparation of Composition Solution)

A composition solution X was obtained in the same manner as in Example 27, except that 0.95 g of the cumene derivative obtained in Example 30 (reactive component) was used instead of 0.62 g of the cumene derivative obtained in Example 27 (reactive component).

The fullerene adduct was confirmed with the composition solution X in the same manner as in Example 1. The results are shown in Table 4.

(Preparation and Evaluation of Lubricating Oil Composition)

A lubricating oil composition Y was obtained in the same manner as in Example 27 except that the composition solution X obtained in Example 30 was used.

The high-temperature wear resistance and load carrying capacity of the lubricating oil composition Y of Example 30 were evaluated in the same manner as in Example 1. The results are shown in Table 4.

Comparative Example 29

A lubricating oil composition Y of Comparative Example 29 was prepared in the same manner as in Example 30 except that the fullerene solution was not heated.

A fullerene adduct was confirmed in the composition solution in the same manner as in Example 1. The results are shown in Table 4.

The wear resistance of the lubricating oil composition Y of Comparative Example 29 was evaluated in the same manner as in Example 1. Table 4 shows the diameter of the rubbing surface 12 hours after the start of heating.

The high-temperature wear resistance and load carrying capacity of the lubricating oil composition Y of Comparative Example 29 were evaluated in the same manner as in Example 1. The results are shown in Table 4.

Example 31

(Synthesis of Reactive Components)

A cumene derivative (reactive component) was obtained in the same manner as in Example 12, except that 100.0 g of one-terminal carbinol-modified silicone oil (X-22-170BX manufactured by Tokyo Chemical Industry Co., Ltd.) was used instead of 3.0 g of butanol (NC4, manufactured by Tokyo Chemical Industry Co., Ltd.), and benzene (Manufactured by Tokyo Chemical Industry Co., Ltd.) and butanol (Manufactured by Tokyo Chemical Industry Co., Ltd.) were mixed in a 4:1 mass ratio in place of toluene as a solvent to be added to the mixture by distillation of acetone.

(Preparation of Composition Solution)

A composition solution X was obtained in the same manner as in Example 12, except that 7.3 g of the cumene derivative obtained in Example 31 (reactive component) was used instead of 0.53 g of the cumene derivative obtained in Example 12 (reactive component).

The fullerene adduct was confirmed with the composition solution X in the same manner as in Example 1. The results are shown in Table 4.

(Preparation and Evaluation of Lubricating Oil Composition)

A lubricating oil composition Y was obtained in the same manner as in Example 12, except that the composition solution X obtained in Example 31 and methylphenyl silicone oil (KF-56, manufactured by Shin-Etsu Chemical Co., Ltd.) were used instead of mineral oil A.

The high-temperature wear resistance and load carrying capacity of the lubricating oil composition Y of Example 31 were evaluated in the same manner as in Example 1. The results are shown in Table 4.

Comparative Example 30

A lubricating oil composition Y of Comparative Example 30 was prepared in the same manner as in Example 31 except that the fullerene solution was not heated.

A fullerene adduct was confirmed in the composition solution in the same manner as in Example 1. The results are shown in Table 4.

The wear resistance of the lubricating oil composition Y of Comparative Example 30 was evaluated in the same manner as in Example 1. Table 4 shows the diameter of the rubbing surface 12 hours after the start of heating.

The high-temperature wear resistance and load carrying capacity of the lubricating oil composition Y of Comparative Example 30 were evaluated in the same manner as in Example 1. The results are shown in Table 4.

Example 32

(Synthesis of Reactive Components)

A cumene derivative (reactive component) was obtained in the same manner as in Example 12, except that 40.0 g of side chain type carbinol-modified silicone oil (X-22-4039, manufactured by Tokyo Chemical Industry Co., Ltd.) was used instead of 3.0 g of butanol (NC4, manufactured by Tokyo Chemical Industry Co., Ltd.), and benzene (Manufactured by Tokyo Chemical Industry Co., Ltd.) and butanol (Manufactured by Tokyo Chemical Industry Co., Ltd.) were mixed in a 4:1 mass ratio in place of toluene as a solvent to be added to the mixture obtained by distilling off acetone.

(Preparation of Composition Solution)

A composition solution X was obtained in the same manner as in Example 12, except that 3.1 g of the cumene derivative obtained in Example 32 (reactive component) was used instead of 0.53 g of the cumene derivative obtained in Example 12 (reactive component).

The fullerene adduct was confirmed with the composition solution X in the same manner as in Example 1. The results are shown in Table 4.

(Preparation and Evaluation of Lubricating Oil Composition)

A lubricating oil composition Y was obtained in the same manner as in Example 31 except that the composition solution X obtained in Example 32 was used.

The high-temperature wear resistance and load carrying capacity of the lubricating oil composition Y of Example 32 were evaluated in the same manner as in Example 1. The results are shown in Table 4.

Comparative Example 31

A lubricating oil composition Y of Comparative Example 31 was prepared in the same manner as in Example 32 except that the fullerene solution was not heated.

A fullerene adduct was confirmed in the composition solution in the same manner as in Example 1. The results are shown in Table 4.

The wear resistance of the lubricating oil composition Y of Comparative Example 31 was evaluated in the same manner as in Example 1. Table 4 shows the diameter of the rubbing surface 12 hours after the start of heating.

The high-temperature wear resistance and load carrying capacity of the lubricating oil composition Y of Comparative Example 31 were evaluated in the same manner as in Example 1. The results are shown in Table 4.

TABLE 3

| | Lubricating oil composition No | | | | | | | | | Evaluation of lubricating oil composition Y | | |
|---|---|---|---|---|---|---|---|---|---|---|---|---|
| | | | Reactive component synthesis | | | Aging Temperature | | Fullerene | | | High temperature | Load carrying |
| | Base oil | Fullerene | Alcohol | Hydroxy-cumene | Solvent | [° C.] × time [hr] | Concen-tration | adduct confirmation | Diluent oil | Wear [μm] | wear resistance | capacity [kN] |
| Example 12 | Toluene | $C_{60}$ | NC4 | CmIP | Toluene | 140 × 16 | 1/10 | Yes | Mineral oil A | 220 | — | — |
| Com. Example 11 | Toluene | $C_{60}$ | NC4 | CmIP | Toluene | No | 1/10 | No | Mineral oil A | 240 | — | — |
| Example 13 | Toluene | $C_{60}$ | IC5 | CmIP | Toluene | 140 × 16 | 1/10 | Yes | Mineral oil A | 210 | — | — |
| Com. Example 12 | Toluene | $C_{60}$ | IC5 | CmIP | Toluene | No | 1/10 | No | Mineral oil A | 240 | — | — |
| Example 14 | Toluene | $C_{60}$ | NC10 | CmIP | Toluene | 140 × 16 | 1/10 | Yes | Mineral oil A | 205 | — | — |
| Com. Example 13 | Toluene | $C_{60}$ | NC10 | CmIP | Toluene | No | 1/10 | No | Mineral oil A | 240 | — | — |
| Example 15 | Toluene | $C_{60}$ | NC10 | CmIB | Toluene | 140 × 16 | 1/10 | Yes | Mineral oil A | 205 | — | — |
| Com. Example 14 | Toluene | $C_{60}$ | NC10 | CmIB | Toluene | No | 1/10 | No | Mineral oil A | 240 | — | — |
| Example 16 | Toluene | $C_{60}$ | NC10 | CmCy | Toluene | 140 × 16 | 1/10 | Yes | Mineral oil A | 205 | — | — |
| Com. Example 15 | Toluene | $C_{60}$ | NC10 | CmCy | Toluene | No | 1/10 | No | Mineral oil A | 240 | — | — |
| Example 17 | Toluene | $C_{60}$ | NC22 | CmIP | Toluene | 140 × 16 | 1/10 | Yes | PAO | 200 | — | — |
| Com. Example 16 | Toluene | $C_{60}$ | NC22 | CmIP | Toluene | No | 1/10 | No | PAO | 230 | — | — |
| Example 18 | Toluene | $C_{60}$ | P2GME | CmIP | THF | 140 × 16 | 1/10 | Yes | POE-A | 235 | — | 7 |
| Com. Example 17 | Toluene | $C_{60}$ | P2GME | CmIP | THF | No | 1/10 | No | POE-A | 250 | — | 5 |
| Example 19 | Toluene | $C_{60}$ | P3GME | CmIP | THF | 140 × 16 | 1/10 | Yes | POE-A | 235 | — | 8 |

TABLE 3-continued

| | Lubricating oil composition No | | | | | | | | | Evaluation of lubricating oil composition Y | | |
|---|---|---|---|---|---|---|---|---|---|---|---|---|
| | | | Reactive component synthesis | | | Aging Temperature | | Fullerene | | | High temperature | Load carrying |
| | Base oil | Fullerene | Alcohol | Hydroxy-cumene | Solvent | [° C.] × time [hr] | Concen-tration | adduct confirmation | Diluent oil | Wear [μm] | wear resistance | capacity [kN] |
| Com. Example 18 | Toluene | $C_{60}$ | P3GME | CmIP | THF | No | 1/10 | No | POE-A | 250 | — | 5 |
| Example 20 | Toluene | $C_{60}$ | P3GME | CmIB | THF | 140 × 16 | 1/10 | Yes | POE-A | 237 | — | 8 |
| Com. Example 19 | Toluene | $C_{60}$ | P3GME | CmIB | THF | No | 1/10 | No | POE-A | 250 | — | 5 |
| Example 21 | Toluene | $C_{60}$ | P3GME | CmCy | THF | 140 × 16 | 1/10 | Yes | POE-A | 228 | — | 7 |
| Com. Example 20 | Toluene | $C_{60}$ | P3GME | CmCy | THF | No | 1/10 | No | POE-A | 250 | — | 5 |
| Example 22 | Toluene | $C_{60}$ | E2GBE | CmIP | THF | 140 × 16 | 1/10 | Yes | POE-A | 210 | — | 7 |
| Com. Example 21 | Toluene | $C_{60}$ | E2GBE | CmIP | THF | No | 1/10 | No | POE-A | 250 | — | 5 |

TABLE 4

| | lubricating oil composition No | | | | | | | | | Evaluation of lubricating oil composition Y | | |
|---|---|---|---|---|---|---|---|---|---|---|---|---|
| | | | Reactive component synthesis | | | Aging Temperature | | Fullerene | | | High temperature | Load carrying |
| | Base oil | Fullerene | Alcohol | Hydroxy-cumene | Solvent | [° C.] × time [hr] | Concen-tration | adduct confirmation | Diluent oil | Wear [μm] | wear resistance | capacity [kN] |
| Example 23 | Toluene | $C_{60}$ | E2GEE | CmIP | THF | 140 × 16 | 1/10 | Yes | POE-A | 230 | — | 7 |
| Com. Example 22 | Toluene | $C_{60}$ | E2GEE | CmIP | THF | No | 1/10 | No | POE-A | 250 | — | 5 |
| Example 24 | Toluene | $C_{60}$ | E6GME | CmIP | THF | 140 × 16 | 1/10 | Yes | POE-A | 205 | — | 6 |
| Com. Example 23 | Toluene | $C_{60}$ | E6GME | CmIP | THF | No | 1/10 | No | POE-A | 250 | — | 5 |
| Example 25 | Toluene | $C_{60}$ | E6GBE | CmIP | THF | 140 × 16 | 1/10 | Yes | POE-A | 210 | — | 10 |
| Com. Example 24 | Toluene | $C_{60}$ | E6GBE | CmIP | THF | No | 1/10 | No | POE-A | 250 | — | 5 |
| Example 26 | Toluene | $C_{60}$ | E3GBS | CmIP | THF | 140 × 16 | 1/10 | Yes | POE-A | 200 | — | 9 |
| Com. Example 25 | Toluene | $C_{60}$ | E3GBS | CmIP | THF | No | 1/10 | No | POE-A | 250 | — | 5 |
| Example 27 | Toluene | $C_{60}$ | GgaE | CmIP | Acetonitrile | 140 × 16 | 1/10 | Yes | POE-B | 220 | — | 9 |
| Com. Example 26 | Toluene | $C_{60}$ | GgaE | CmIP | Acetonittale | No | 1/10 | No | POE-B | 245 | — | 4 |
| Example 28 | Toluene | $C_{60}$ | GgaE | CmIB | Acetonitrile | 140 × 16 | 1/10 | Yes | POE-B | 210 | — | 6 |
| Com. Example 27 | Toluene | $C_{60}$ | GgaE | CmIB | Acetonitrile | No | 1/10 | No | POE-B | 245 | — | 4 |
| Example 29 | Toluene | $C_{60}$ | GgaE | CmCy | Acetonitrile | 140 × 16 | 1/10 | Yes | POE-B | 213 | — | 9 |
| Com. Example 28 | Toluene | $C_{60}$ | GgaE | CmCy | Acetonitrile | No | 1/10 | No | POE-B | 245 | — | 4 |
| Example 30 | Toluene | $C_{60}$ | TpaMS | CmIP | Acetonitrile | 140 × 16 | 1/10 | Yes | POE-B | 200 | — | 7 |

TABLE 4-continued

| | lubricating oil composition No | | | | | | | | | Evaluation of lubricating oil composition Y | | |
|---|---|---|---|---|---|---|---|---|---|---|---|---|
| | | | Reactive component synthesis | | | Aging Temperature | Fullerene | | | | High temperature | Load carrying |
| | Base oil | Fullerene | Alcohol | Hydroxy-cumene | Solvent | [° C.] × time [hr] | Concen-tration | adduct confirmation | Diluent oil | Wear [μm] | wear resistance | capacity [kN] |
| Com. Example 29 | Toluene | $C_{60}$ | TpaMS | CmIP | Acetonitrile | No | 1/10 | No | POE-B | 245 | — | 4 |
| Example 31 | Toluene | $C_{60}$ | No-22-170BNo | CmIP | Mixure | 140 × 16 | 1/10 | Yes | KF56 | 255 | 260 | — |
| Com. Example 30 | Toluene | $C_{60}$ | No-22-170BNo | CmIP | Mixure | No | 1/10 | No | KF56 | 265 | 285 | — |
| Example 32 | Toluene | $C_{60}$ | No-22-4039 | CmIP | Mixure | 140 × 16 | 1/10 | Yes | KF56 | 250 | 265 | — |
| Com. Example 31 | Toluene | $C_{60}$ | No-22-4039 | CmIP | Mixure | No | 1/10 | No | KF56 | 265 | 285 | — |

From the results of Tables 3 and 4, Examples 12 to 32 were found to have better wear resistance than the corresponding Comparative Examples 11 to 31.

From the results of Tables 3 and 4, it was found that Examples 18 to 30 had better load carrying capacity than the corresponding Comparative Examples 17 to 29.

From the results of Tables 3 and 4, Example 31 and Example 32 were found to have better high-temperature wear resistance than the corresponding Comparative Examples 30 and 31.

Example 33

A lubricating oil composition Y of Example 33 was prepared in the same manner as (Preparation of Composition Solution) (Preparation and Evaluation of Lubricating Oil Composition) of Example 12, except that a lubricating oil composition X was obtained by using 100 g of benzene (Manufactured by Tokyo Chemical Industry Co., Ltd.) as a base oil and 1 g of tricresyl phosphate (TCP, manufactured by Tokyo Chemical Industry Co., Ltd.) as a reactive component, and a concentrated lubricating oil composition X was added to 100 g of mineral oil B (Super Oil M32, manufactured by JXTG Energy Corporation) to obtain a lubricating oil composition Y.

A fullerene adduct was confirmed for the lubricating oil composition X in the same manner as in Example 1. The results are shown in Table 5.

The wear resistance, high-temperature wear resistance, and load carrying capacity of the lubricating oil composition Y of Example 33 were evaluated in the same manner as in Example 1. The results are shown in Table 5.

Comparative Example 32

A lubricating oil composition Y of Comparative Example 32 was prepared in the same manner as in Example 33 except that the fullerene solution was not heated.

A fullerene adduct was confirmed for the lubricating oil composition X in the same manner as in Example 1. The results are shown in Table 5.

The wear resistance, high-temperature wear resistance, and load carrying capacity of the lubricating oil composition Y of Comparative Example 32 were evaluated in the same manner as in Example 1. The results are shown in Table 5.

Example 34

A lubricating oil composition Y of Example 34 was prepared in the same manner as (Preparation of Composition Solution) (Preparation and Evaluation of Lubricating Oil Composition) of Example 12, except that 1 g of triphenyl phosphate (TPP, manufactured by Tokyo Chemical Industry Co., Ltd.) was used as a reactive component, the fullerene solution was heated at 160° C. for 16 hours to remove volatile components to obtain a lubricating oil composition X, and that concentrated lubricating oil composition X was added to 100 g of mineral oil B (Super Oil M 32, manufactured by JXTG Energy Corporation) to obtain a lubricating oil composition Y.

A fullerene adduct was confirmed for the lubricating oil composition X in the same manner as in Example 1. The results are shown in Table 5.

The wear resistance, high-temperature wear resistance, and load carrying capacity of the lubricating oil composition Y of Example 34 were evaluated in the same manner as in Example 1. The results are shown in Table 5.

Comparative Example 33

A lubricating oil composition Y of Comparative Example 33 was prepared in the same manner as in Example 34 except that the fullerene solution was not heated.

A fullerene adduct was confirmed for the lubricating oil composition X in the same manner as in Example 1. The results are shown in Table 5.

The wear resistance, high-temperature wear resistance, and load carrying capacity of the lubricating oil composition Y of Comparative Example 33 were evaluated in the same manner as in Example 1. The results are shown in Table 5.

Example 35

A lubricating oil composition Y of Example 35 was prepared in the same manner as (Preparation of Composition Solution) (Preparation and Evaluation of Lubricating Oil Composition) of Example 12, except that 1 g of dibenzyldisulfide (DBDS, manufactured by Tokyo Chemical Industry Co., Ltd.) was used as a reactive component, the fullerene solution was heated at 140° C. for 8 hours to remove volatiles to obtain a lubricating oil composition X, and that concentrated lubricating oil composition X was added to 100 g of mineral oil B (Super Oil M 32, manufactured by JXTG Energy Corporation) to obtain a lubricating oil composition Y.

A fullerene adduct was confirmed for the lubricating oil composition X in the same manner as in Example 1. The results are shown in Table 5.

The wear resistance, high-temperature wear resistance, and load carrying capacity of the lubricating oil composition Y of Example 35 were evaluated in the same manner as in Example 1. The results are shown in Table 5.

Comparative Example 34

A lubricating oil composition Y of Comparative Example 34 was prepared in the same manner as in Example 35 except that the fullerene solution was not heated.

A fullerene adduct was confirmed for the lubricating oil composition X in the same manner as in Example 1. The results are shown in Table 5.

The wear resistance, high-temperature wear resistance, and load carrying capacity of the lubricating oil composition Y of Comparative Example 34 were evaluated in the same manner as in Example 1. The results are shown in Table 5.

Example 36

A lubricating oil composition Y of Example 36 was prepared in the same manner as (Preparation of Composition Solution) (Preparation and Evaluation of Lubricating Oil Composition) of Example 12, except that 1 g of di-p-tolyl disulfide (DTDS, manufactured by Tokyo Chemical Industry Co., Ltd.) was used as a reactive component, and the fullerene solution was heated at 160° C. for 8 hours to remove volatiles to obtain a lubricating oil composition X, and that concentrated lubricating oil composition X was added to 100 g of mineral oil B (Super Oil M 32, manufactured by JXTG Energy Corporation) to obtain a lubricating oil composition Y.

A fullerene adduct was confirmed for the lubricating oil composition X in the same manner as in Example 1. The results are shown in Table 5.

The wear resistance, high-temperature wear resistance, and load carrying capacity of the lubricating oil composition Y of Example 36 were evaluated in the same manner as in Example 1. The results are shown in Table 5.

Comparative Example 35

A lubricating oil composition Y of Comparative Example 35 was prepared in the same manner as in Example 36 except that the fullerene solution was not heated.

A fullerene adduct was confirmed for the lubricating oil composition X in the same manner as in Example 1. The results are shown in Table 5.

The wear resistance, high-temperature wear resistance, and load carrying capacity of the lubricating oil composition Y of Comparative Example 35 were evaluated in the same manner as in Example 1. The results are shown in Table 5.

Example 37

A lubricating oil composition Y of Example 37 was prepared in the same manner as (Preparation of Composition Solution) (Preparation and Evaluation of Lubricating Oil Composition) of Example 12, except that 1 g of 2,6-di-tert-butylphenol (DTP, manufactured by Tokyo Chemical Industry Co., Ltd.) was used as a reactive component, the fullerene solution was heated at 140° C. for 8 hours to remove volatiles to obtain a lubricating oil composition X, and that concentrated lubricating oil composition X was added to 100 g of mineral oil B (Super Oil M 32, manufactured by JXTG Energy Corporation) to obtain a lubricating oil composition Y.

A fullerene adduct was confirmed for the lubricating oil composition X in the same manner as in Example 1. The results are shown in Table 5.

The wear resistance, high-temperature wear resistance, and load carrying capacity of the lubricating oil composition Y of Example 37 were evaluated in the same manner as in Example 1. The results are shown in Table 5.

Comparative Example 36

A lubricating oil composition Y of Comparative Example 36 was prepared in the same manner as in Example 37 except that the fullerene solution was not heated.

A fullerene adduct was confirmed for the lubricating oil composition X in the same manner as in Example 1. The results are shown in Table 5.

The wear resistance, high-temperature wear resistance, and load carrying capacity of the lubricating oil composition Y of Comparative Example 36 were evaluated in the same manner as in Example 1. The results are shown in Table 5.

Example 38

A lubricating oil composition Y of Example 38 was prepared in the same manner as (Preparation of Composition Solution) (Preparation and Evaluation of Lubricating Oil Composition) of Example 12, except that 1 g of bis (3,5-di-tert-butyl-4-hydroxyphenyl) methane (BDBA, manufactured by Tokyo Chemical Industry Co., Ltd.) was used as a reactive component, and the fullerene solution was heated at 140° C. for 4 hours to remove volatile components to obtain a lubricating oil composition X, and that concentrated lubricating oil composition X was added to 100 g of mineral oil B (Super Oil M 32, manufactured by JXTG Energy Corporation) to obtain a lubricating oil composition Y.

A fullerene adduct was confirmed for the lubricating oil composition X in the same manner as in Example 1. The results are shown in Table 5.

The wear resistance, high-temperature wear resistance, and load carrying capacity of the lubricating oil composition Y of Example 38 were evaluated in the same manner as in Example 1. The results are shown in Table 5.

Comparative Example 37

A lubricating oil composition Y of Comparative Example 37 was prepared in the same manner as in Example 38 except that the fullerene solution was not heated.

A fullerene adduct was confirmed for the lubricating oil composition X in the same manner as in Example 1. The results are shown in Table 5.

The wear resistance, high-temperature wear resistance, and load carrying capacity of the lubricating oil composition Y of Comparative Example 37 were evaluated in the same manner as in Example 1. The results are shown in Table 5.

Example 39

A lubricating oil composition Y of Example 39 was prepared in the same manner as (Preparation of Composition Solution) (Preparation and Evaluation of Lubricating Oil Composition) of Example 12, except that 1 g of 2,4,6-tributylphenol (TBP, manufactured by Tokyo Chemical Industry Co., Ltd.) was used as a reactive component, the fullerene solution was heated at 140° C. for 8 hours to remove volatile components to obtain a lubricating oil composition X, and that concentrated lubricating oil composition X was added to 100 g of mineral oil B (Super Oil M 32, manufactured by JXTG Energy Corporation) to obtain a lubricating oil composition Y.

A fullerene adduct was confirmed for the lubricating oil composition X in the same manner as in Example 1. The results are shown in Table 5.

The wear resistance, high-temperature wear resistance, and load carrying capacity of the lubricating oil composition Y of Example 39 were evaluated in the same manner as in Example 1. The results are shown in Table 5.

Comparative Example 38

A lubricating oil composition Y of Comparative Example 38 was prepared in the same manner as in Example 39 except that the fullerene solution was not heated.

A fullerene adduct was confirmed for the lubricating oil composition X in the same manner as in Example 1. The results are shown in Table 5.

The wear resistance, high-temperature wear resistance, and load carrying capacity of the lubricating oil composition Y of Comparative Example 38 were evaluated in the same manner as in Example 1. The results are shown in Table 5.

Example 40

A lubricating oil composition Y of Example 40 was prepared in the same manner as (Preparation of Composition Solution) (Preparation and Evaluation of Lubricating Oil Composition) of Example 12, except that 1 g of 3,5-di-tert-butyl-4 hydroxytoluene (BHT manufactured by Tokyo Chemical Industry Co., Ltd.) was used as a reactive component, and the fullerene solution was heated at 140° C. for 4 hours to remove volatiles to obtain a lubricating oil composition X, and that concentrated lubricating oil composition X was added to 100 g of mineral oil B (Super Oil M 32, manufactured by JXTG Energy Corporation) to obtain a lubricating oil composition Y.

A fullerene adduct was confirmed for the lubricating oil composition X in the same manner as in Example 1. The results are shown in Table 5.

The wear resistance, high-temperature wear resistance, and load carrying capacity of the lubricating oil composition Y of Example 40 were evaluated in the same manner as in Example 1. The results are shown in Table 5.

Comparative Example 39

A lubricating oil composition Y of Comparative Example 39 was prepared in the same manner as in Example 40 except that the fullerene solution was not heated.

A fullerene adduct was confirmed for the lubricating oil composition X in the same manner as in Example 1. The results are shown in Table 5.

The wear resistance, high-temperature wear resistance, and load carrying capacity of the lubricating oil composition Y of Comparative Example 39 were evaluated in the same manner as in Example 1. The results are shown in Table 5.

Example 41

The lubricating oil composition Y of Example 41 was prepared in the same manner as in Example 33, except that 1 g of tricresyl phosphate (TCP, manufactured by Tokyo Chemical Industry Co., Ltd.) was used as a base oil and a reactive component, and the lubricating oil composition X was obtained, and no concentration was performed, and 0.1 g of the lubricating oil composition X was added to 100 g of mineral oil B to obtain the lubricating oil composition Y.

A fullerene adduct was confirmed for the lubricating oil composition X in the same manner as in Example 1. The results are shown in Table 5.

The wear resistance, high-temperature wear resistance, and load carrying capacity of the lubricating oil composition Y of Example 41 were evaluated in the same manner as in Example 1. The results are shown in Table 5.

Comparative Example 40

A lubricating oil composition Y of Comparative Example 40 was prepared in the same manner as in Example 41 except that the fullerene solution was not heated.

A fullerene adduct was confirmed for the lubricating oil composition X in the same manner as in Example 1. The results are shown in Table 5.

The wear resistance, high-temperature wear resistance, and load carrying capacity of the lubricating oil composition Y of Comparative Example 40 were evaluated in the same manner as in Example 1. The results are shown in Table 5.

Example 42

The lubricating oil composition Y of Example 42 was prepared in the same manner as in Example 33, except that 1 g of triphenyl phosphate (TPP, manufactured by Tokyo Chemical Industry Co., Ltd.) was used as a base oil and a reactive component, and the fullerene solution was heated at 160° C. for 16 hours to remove volatiles to obtain the lubricating oil composition X, and no concentration was performed, and the lubricating oil composition X 0.1 g was added to 100 g of mineral oil B to obtain the lubricating oil composition Y.

A fullerene adduct was confirmed for the lubricating oil composition X in the same manner as in Example 1. The results are shown in Table 5.

The wear resistance, high-temperature wear resistance, and load carrying capacity of the lubricating oil composition Y of Example 42 were evaluated in the same manner as in Example 1. The results are shown in Table 5.

Comparative Example 41

A lubricating oil composition Y of Comparative Example 41 was prepared in the same manner as in Example 42 except that the fullerene solution was not heated.

A fullerene adduct was confirmed for the lubricating oil composition X in the same manner as in Example 1. The results are shown in Table 5.

The wear resistance, high-temperature wear resistance, and load carrying capacity of the lubricating oil composition Y of Comparative Example 41 were evaluated in the same manner as in Example 1. The results are shown in Table 5.

TABLE 5

| | Lubricating oil composition No | | | | | | | | Evaluation of lubricating oil composition Y | | |
|---|---|---|---|---|---|---|---|---|---|---|---|
| | Base oil | Fullerene | Reactive component | Aging Temperature [° C.] × time [hr] | Aging (Heat treatment) Nitrogen substitution | Concen-tration | Fullerene adduct confirmation | Diluent oil | Wear [μm] | High temperature wear resistance | Load carrying capacity [kN] |
| Example 33 | Benzene | $C_{60}$ | TCP | 140 × 16 | Yes | 1/10 | Yes | Mineral oil B | 230 | — | 15 |
| Com. Example 32 | Benzene | $C_{60}$ | TCP | No | — | 1/10 | No | Mineral oil B | 260 | — | 10 |
| Example 34 | Benzene | $C_{60}$ | TCP | 160 × 16 | Yes | 1/10 | Yes | Mineral oil B | 225 | — | 14 |
| Com. Example 33 | Benzene | $C_{60}$ | TCP | No | — | 1/10 | No | Mineral oil B | 260 | — | 9 |
| Example 35 | Benzene | $C_{60}$ | DBDS | 140 × 8 | Yes | 1/10 | Yes | Mineral oil B | 260 | — | 12 |
| Com. Example 34 | Benzene | $C_{60}$ | DBDS | No | — | 1/10 | No | Mineral oil B | 280 | — | 7 |
| Example 36 | Benzene | $C_{60}$ | DTDS | 160 × 8 | Yes | 1/10 | Yes | Mineral oil B | 270 | — | 13 |
| Com. Example 35 | Benzene | $C_{60}$ | DTDS | No | — | 1/10 | No | Mineral oil B | 290 | — | 8 |
| Example 37 | Benzene | $C_{60}$ | DTP | 140 × 8 | Yes | 1/10 | Yes | Mineral oil B | 270 | 310 | — |
| Com. Example 36 | Benzene | $C_{60}$ | DTP | No | — | 1/10 | No | Mineral oil B | 280 | 340 | — |
| Example 38 | Benzene | $C_{60}$ | BDBA | 140 × 4 | Yes | 1/10 | Yes | Mineral oil B | 275 | 305 | — |
| Com. Example 37 | Benzene | $C_{60}$ | BDBA | No | — | 1/10 | No | Mineral oil B | 280 | 340 | — |
| Example 39 | Benzene | $C_{60}$ | TBP | 140 × 8 | Yes | 1/10 | Yes | Mineral oil B | 275 | 320 | — |
| Com. Example 38 | Benzene | $C_{60}$ | TBP | No | — | 1/10 | No | Mineral oil B | 280 | 340 | — |
| Example 40 | Benzene | $C_{60}$ | BHT | 140 × 4 | Yes | 1/10 | Yes | Mineral oil B | 270 | 300 | — |
| Com. Example 39 | Benzene | $C_{60}$ | BHT | No | — | 1/10 | No | Mineral oil B | 280 | 340 | — |
| Example 41 | TCP | $C_{60}$ | No(TCP) | 140 × 16 | Yes | No | Yes | Mineral oil B | 230 | — | 15 |
| Com. Example 40 | TCP | $C_{60}$ | No(TCP) | No | — | No | No | Mineral oil B | 260 | — | 10 |
| Example 42 | TCP | $C_{60}$ | No(TCP) | 160 × 16 | Yes | No | Yes | Mineral oil B | 225 | — | 14 |
| Com. Example 41 | TCP | $C_{60}$ | No(TCP) | No | — | No | No | Mineral oil B | 260 | — | 9 |

From the results of Table 5, it was found that Examples 33 to 36 had better wear resistance and load carrying capacity than the corresponding Comparative Examples 32 to 35.

From the results of Table 5, it was found that Examples 37 to 40 had better wear resistance and high-temperature wear resistance than the corresponding Comparative Examples 36 to 39.

From the results of Table 5, it was found that Example 41 and Example 42 had better wear resistance and load carrying capacity than the corresponding Comparative Examples 40 and 41.

INDUSTRIAL APPLICABILITY

The wear resistance can be improved by using a lubricating oil composition containing a base oil and a fullerene adduct. Therefore, the present invention is effective in preventing the metal portion from being damaged or worn in the sliding portion of an automobile, a household appliance, an industrial machine, or the like.

The invention claimed is:

1. A lubricating oil composition comprising: a base oil and a fullerene adduct, wherein the fullerene adduct is a compound obtained by adding at least one compound selected from the group consisting of 1,2,4-trimethylbenzene, a cumene, a compound having an ether bond, a compound having an ester bond, a compound having a phosphate ester bond, a compound having a disulfide bond, a compound having a phenol hydroxyl group, and a silicone, to a fullerene;

wherein the compound having an ether bond is selected from the group consisting of polyalkylvinyl ether, dialkyl diphenyl ether, polyphenyl ether, tripropylene glycol, dipropylene glycol, triethylene glycol, tetrahydrofuran, and di-p-tolyl ether; and wherein the compound having an ester bond is selected from the group consisting of tribasic acid ester, ethyl acetate, octyl acetate, and polyol ester.

2. The lubricating oil composition according to claim 1, wherein the fullerene is a mixture comprising $C_{60}$ and $C_{70}$.

3. The lubricating oil composition according to claim 1, further comprising an oil different from the base oil.

4. A method of producing a lubricating oil composition according to claim 1, the method comprising:

obtaining a mixture of the base oil and a fullerene by mixing the base oil and the fullerene, and dissolving the dissolved component of the fullerene in the base oil; and heat-treating the mixture in an atmosphere containing lower oxygen content than in air.

5. The method of producing a lubricating oil composition according to claim 4, further comprising: adding a reactive component reactive with the fullerene to the mixture.

6. The method of producing a lubricating oil composition, according to claim 4, further comprising: diluting the mixture with the base oil or an oil different from the base oil.

7. The lubricating oil composition according to claim 1, wherein the at least one compound comprises dimethylcumene.

8. The lubricating oil composition according to claim 1, wherein the at least one compound comprises di-p-tolyl ether.

9. The lubricating oil composition according to claim 1, wherein the at least one compound comprises methylphenyl silicone oil.

10. The lubricating oil composition according to claim 1, wherein the at least one compound comprises dimethyl silicone oil.

11. The lubricating oil composition according to claim 1, wherein the at least one compound comprises hydroxycumene.

12. The lubricating oil composition according to claim 1, wherein the at least one compound comprises tricresyl phosphate.

13. The lubricating oil composition according to claim 1, wherein the at least one compound comprises dibenzyldisulfide.

14. The lubricating oil composition according to claim 1, wherein the at least one compound comprises di-p-tolyl disulfide.

15. The lubricating oil composition according to claim 1, wherein the at least one compound comprises 2,6-di-tert-butylphenol.

16. The lubricating oil composition according to claim 1, wherein the at least one compound comprises bis (3,5-ditert-butyl-4-hydroxyphenyl) methane.

17. The lubricating oil composition according to claim 1, wherein the at least one compound comprises 3,5-di-tert-butyl-4 hydroxytoluene.

18. The lubricating oil composition according to claim 1, wherein the at least one compound comprises 2,4,6-tributylphenol.

19. The lubricating oil composition according to claim 1, wherein the at least one compound comprises polyol ester.

* * * * *